US011891793B2

(12) United States Patent
Clark

(10) Patent No.: US 11,891,793 B2
(45) Date of Patent: Feb. 6, 2024

(54) RESILIENT BUILDING AND SITE CONSTRUCTION SYSTEM AND METHOD

(71) Applicant: George Clark, Wilmington, NC (US)

(72) Inventor: George Clark, Wilmington, NC (US)

(73) Assignee: STEEL STRUCTURES, LLC, Wilmington, NC (US)

( * ) Notice: Subject to any disclaimer, the term of this patent is extended or adjusted under 35 U.S.C. 154(b) by 47 days.

(21) Appl. No.: 17/465,704

(22) Filed: Sep. 2, 2021

(65) Prior Publication Data

US 2022/0074194 A1 Mar. 10, 2022

Related U.S. Application Data

(60) Provisional application No. 63/074,649, filed on Sep. 4, 2020.

(51) Int. Cl.
*E04B 1/343* (2006.01)
*E04H 1/12* (2006.01)

(52) U.S. Cl.
CPC ..... *E04B 1/34384* (2013.01); *E04H 1/12* (2013.01); *E04H 2001/1283* (2013.01)

(58) Field of Classification Search
CPC ..... E04B 1/34384; E04B 1/348; E04H 1/12; E04H 2001/1283; E04H 1/005
See application file for complete search history.

(56) References Cited

U.S. PATENT DOCUMENTS

| | | | | |
|---|---|---|---|---|
| 4,722,155 | A * | 2/1988 | Ericsson | E04H 9/10 52/127.4 |
| 5,735,639 | A * | 4/1998 | Payne | B65D 90/0013 588/259 |
| 8,484,929 | B1 * | 7/2013 | Begdouri | B65D 88/76 52/745.03 |
| 9,695,608 | B2 | 7/2017 | French | |
| 10,633,877 | B2 * | 4/2020 | Wolff | E04B 1/34315 |
| 10,704,251 | B1 * | 7/2020 | Rubler | E04B 1/34815 |
| 11,001,187 | B1 * | 5/2021 | Kelly | B60P 3/32 |
| 11,492,795 | B2 * | 11/2022 | Williams | E04H 1/005 |
| 2007/0271857 | A1 * | 11/2007 | Heather | B65D 90/006 52/79.9 |
| 2012/0279141 | A1 * | 11/2012 | Wiederick | E04H 5/02 52/79.5 |

(Continued)

*Primary Examiner* — Gisele D Ford
(74) *Attorney, Agent, or Firm* — Merek, Blackmon & Voorhees, LLC

(57) ABSTRACT

A system, elements of the system and a method of forming scalable, compatible and resilient building structures. Preferably, one or more of (i) standard intermodal containers or racks (steel cuboidal versions as well as flat racks typically used on cargo ships); (ii) pallet racks (steel frame versions typically used in warehouses), and/or (iii) boat storage racks (steel frame versions typically used in marinas) are utilized to form a main structure/assembly (e.g., outer shell or frame) of a building structure that is easily assembled with width ranges from, for example, 24 feet wide to 40 feet wide, a length of 40 feet or longer and multiple stories or levels (e.g., 2 to 4 stories or levels). Preferably, existing portions of containers and associated racks are used to interconnect these members/elements (e.g., casting corners or fork-lift receiving channels/sections/portions) to form scalable, compatible and resilient building structures.

19 Claims, 40 Drawing Sheets

(56) References Cited

U.S. PATENT DOCUMENTS

| | | | | |
|---|---|---|---|---|
| 2014/0298734 | A1* | 10/2014 | Rogers | H05K 7/1497 52/79.9 |
| 2014/0298745 | A1* | 10/2014 | Rechenmacher | E04H 1/005 52/425 |
| 2016/0017601 | A1* | 1/2016 | Bottin | E04B 5/10 52/125.1 |
| 2016/0069064 | A1* | 3/2016 | Martin | E04B 1/34336 52/79.7 |
| 2016/0130795 | A1* | 5/2016 | Downey | E04H 1/005 52/745.02 |
| 2016/0160515 | A1* | 6/2016 | Wallance | E04F 10/10 52/745.02 |
| 2016/0194863 | A1* | 7/2016 | Schmitt | E04H 1/00 52/745.02 |
| 2017/0121990 | A1* | 5/2017 | Armstrong | E04H 1/005 |
| 2017/0198489 | A1* | 7/2017 | Klein | E04B 1/34384 |
| 2019/0186122 | A1* | 6/2019 | Patterson | E04B 1/10 |
| 2021/0054613 | A1* | 2/2021 | Peck | E04B 1/3483 |
| 2021/0062495 | A1* | 3/2021 | Ligeti | E04B 1/34861 |
| 2022/0049491 | A1* | 2/2022 | Yoshitaka | E04B 1/2403 |
| 2022/0064935 | A1* | 3/2022 | Williams | F24F 3/167 |
| 2022/0205235 | A1* | 6/2022 | Chapman | E04B 1/34853 |
| 2022/0275632 | A1* | 9/2022 | Davies | E04B 1/3483 |

* cited by examiner

RESILIENT BUILDING AND SITE CONSTRUCTION SYSTEM AND METHOD

RELATED APPLICATION

The subject patent application claims priority from U.S. Provisional Patent Application Ser. No. 63/074,649 filed on Sep. 4, 2020 the entire contents of which is incorporated herein by reference.

FIELD OF THE INVENTION

Preferred forms of the present invention are directed generally to an ordered and comprehensive assemblage of main elements and components for a building and site improvements. More specifically, preferred forms of the present invention include scalable systems, system elements or members and methods for construction of resilient building structures and associated site and utility improvements which preferably include the use of one or more of: (i) standard intermodal containers or racks (steel cuboidal versions as well as flat racks typically used on cargo ships); (ii) pallet racks (steel frame versions typically used in warehouses), and/or (iii) boat storage racks (steel frame versions typically used in marinas) for structural and nonstructural components of one or more building structures.

BACKGROUND OF THE INVENTION

A building is a structure which typically includes exterior walls, roof, footings, foundations, structural portions of load-bearing walls, structural floors and subfloors, and structural columns and beams. A site may include real property (i.e., real estate) that is owned privately or publicly. Site improvements may be defined as changing landforms from a natural, semi-natural, or previously developed state for a different use. Site improvements may be used to upgrade or replace existing features in order to maximize the best use of a property. These improvements may be completed as new development or redevelopment, additions to or adaptive reuse of existing structures, site features and or utility systems. Further examples of site improvements may include: road construction or other transportation improvement; access driveways, walkways, parking areas; bridging, platforms, raised thoroughfares; clearing, grading, terracing or land levelling, landscaping; utility and other service connections to municipal or private systems; stormwater facilities for storage, collection and or conveyance of runoff.

Potential developable areas may take on various forms, such as raw land, or previously developed properties with or without existing structures, entitlements, encumbrances; examples of encumbrances include: utility easements, access easements, or future public right of way expansions. Potential developable areas may be a factor of property size, current or proposed zoning, and encumbrances for the subject property. Examples of potential developable areas may include main building additions or accessory structures, detached or attached structures above or below ground. ("ground" to mean finished ground, grade or elevation). Owners may need to maximize their use of property in order to maintain affordability and increase value. Examples may include:

- Sublease a portion of the home and shared use of common areas as room,
- Lease a separate apartment, lower level, or other onsite dwelling that may be an accessory to the principal use of the property, and

- Sublease a portion of the property such as driveway, garage, or storage space.

Modifications to the existing structure or property may be required to achieve this. Examples may include:

- Renovate existing structure and add square footage by expanding vertically or horizontally, typically off of the rear,
- Construct one or more detached structures on the property as additional storage, garage, office, accessory dwelling unit (ADU), etc., and
- Raze existing structure, build new construction as an infill, redevelopment project that maximizes highest possible use of a property.

Currently, construction of new structures and site improvements tend to be piecemeal, wasteful and lack resilience, compatibility, scalability. Long term maintenance and operations and high performance features tend to be a priority for high end projects only. Underutilized properties, the need for scalable and compatible building and sites, and a huge need for more resilient structures are the main reasons for development of the concepts within this disclosure. Therefore, what is needed are techniques that overcome the above mentioned disadvantages.

OBJECTS AND SUMMARY OF THE INVENTION

An object of a preferred form of the present invention is to provide a novel and unobvious method and apparatus for forming a scalable, compatible and/or resilient building structure.

Another object of a preferred form of the present invention is to provide a method and apparatus for forming a scalable, compatible and/or resilient building structure that is easily assembled with width ranges from, for example, 24 feet wide to 40 feet wide, a length of 40 feet or longer and multiple stories or levels (e.g., 2 to 4 stories or levels) without conventional interior support columns or posts.

Yet another object of a preferred form of the present invention is directed to a building structure that utilizes one or more high cube box shipping containers to form a structural support member, assembly or a portion (e.g., outer shell or frame) of a building structure.

A further object of a preferred form of the present invention is directed to a building structure that utilizes one or more high cube box shipping containers to form a level (e.g., ground level, below grade level or a level above ground) of a building structure.

Still another object of a preferred form of the present invention is directed to a building structure that utilizes one or more columns of stacked high cube box shipping containers to form a plurality of levels of a building structure.

Still a further object of a preferred form of the present invention is to provide a system and method that utilizes one of more high cube box shipping containers in combination with one or more flat racks to form a scalable, compatible and/or resilient building structure that is easily assembled with width ranges from, for example, 24 feet wide to 40 feet wide, a length of 40 feet or longer and multiple stories or levels (e.g., 2 to 4 stories or levels) without conventional interior support columns or posts as the one or more high cube box shipping containers in combination with one or more flat racks obviate the need for certain conventional interior support columns or posts.

Yet another object of a preferred form on the present invention is to provide a system and method that utilizes one of more high cube box shipping containers in combination with one or more flat racks and existing portions of the members/elements to interconnect these members/elements (e.g., casting corners or fork-lift receiving channels/sections/portions).

Yet a further object of a preferred form on the present invention is to provide a system and method that utilizes existing casting corners of containers and/or flat racks to form stacked columns of containers and/or flat racks.

Still a further object of a preferred form of the present invention is to provide a system and method that utilizes existing fork-lift receiving channels/sections/portions to structurally connect high cube box shipping containers and/or flat racks.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention. Further, the above is not an exhaustive list of the advantages and objects of the preferred forms of the present invention. Other advantages and objects of preferred forms of the present invention will be readily appreciated from the description of the preferred forms of the present invention.

In summary, one preferred embodiment of the present invention is directed to a building structure including a first building level of a building structure formed from at least a first high cube box shipping container and a second high cube box shipping container. The first high cube box shipping container forming at least a first side portion of the first building level and the second high cube box shipping container forming at least a second side portion of the first building level, wherein the roof, both end walls and a sidewall of each of the first and second high cube box shipping containers are removed to provide a first floor space extending between an exterior sidewall of the first high cube box shipping container and an exterior wall of the second high cube box shipping container. A floor of said first building level is operably connected to each of the first high cube box shipping container and the second high cube box shipping container.

Another preferred embodiment of the present invention is directed to a method of forming a building structure, comprising the steps of: (a) providing a first high cube box shipping container and a second high cube box shipping container; (b) positioning the first high cube box shipping container to form at least a first side portion of a first level of a building structure; (c) positioning the second high cube box shipping container to form at least a second side portion of the first level of the building structure, wherein the roof, both end walls and a sidewall of each of the first and second high cube box shipping containers are removed to provide an interior space of the first level of the building structure extending between an exterior sidewall of the first high cube box shipping container and an exterior wall of the second high cube box shipping container; and, (c) operably connecting a floor to the first high cube box shipping container and the second high cube box shipping container.

A further embodiment of the present invention is directed to a method of forming a building structure, comprising the steps of: (a) providing a first high cube box shipping container and a first flat rack; (b) positioning the first high cube box shipping container to form at least a first side portion of a first level of a building structure, wherein the roof, both end walls and a sidewall of the first high cube box shipping container are removed to provide an interior space of the first level of the building structure extending between an exterior sidewall of the first high cube box shipping container and an interior wall of the first high cube box shipping container; (c) horizontally offsetting the first flat rack from the first high cube box shipping container such that a floor of the first high cube box shipping container is substantially horizontally aligned with a top surface of the first flat rack, wherein the first flat rack has a plurality of openings extending therethrough so that a fork-lift can engage, and lift the first flat rack from either side of the first flat rack; and, (d) inserting a portion of a first cross-beam into one of the plurality of openings of the first flat rack and connecting a first end of the first cross-beam to a portion of the first high cube box shipping container.

The above summary describes preferred forms of the present invention and is not in any way to be construed as limiting the claimed invention to the preferred forms.

DETAILED DESCRIPTION OF THE PREFERRED EMBODIMENTS OF THE INVENTION

Figure 1:
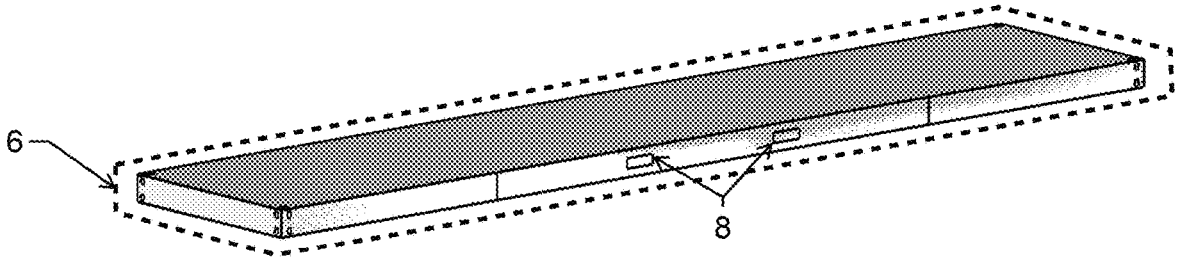
FIG. 1 is a perspective view of one preferred core or main building structure forming member.

The preferred forms of the invention are described below with reference to the drawings. The appended claims are not limited to the preferred forms and no term and/or phrase used herein is to be given a meaning other than its ordinary meaning unless it is expressly stated otherwise.

The preferred forms of the present invention are directed to systems, system elements/members and methods of constructing a scalable, compatible and resilient building structure that is easy to assembly. One or more of (i) standard intermodal containers or racks (steel cuboidal versions as well as flat racks typically used on cargo ships); (ii) pallet racks (steel frame versions typically used in warehouses), and/or (iii) boat storage racks (steel frame versions typically used in marinas) are utilized to form a main structure/assembly (e.g., outer shell or frame) of a building structure that is easily assembled with readily variable width ranges (for example, 24 feet wide to 40 feet wide), a length of 40 feet or longer and multiple stories or levels (e.g., 2 to 4 stories or levels). Preferably, existing portions of containers and associated racks are used to interconnect these members/elements (e.g., casting corners or fork-lift receiving channels/sections/portions) to form scalable, compatible and resilient building structures.

One preferred embodiment utilizes one or more columns of stacked shipping containers and one or more columns of stacked flat racks as the core members of elements for forming an outer structural shell or structural frame of a building structure. While drawings show a specific number of stories or levels of various building structures, the number of stories and levels can be modified as desired. In one preferred form, one or more columns of stacked high cube box shipping containers having a width of 8 ft, a length of 40 feet and a height of 9.5 feet are used to form an outer structural shell or structural frame of a building structure. Utilizing shipping containers of this size allows the height of any level of the building structure to have a suitable height (e.g., greater than 8 feet) even after the finishing members are added (e.g., drywall for ceiling).

Preferably, the roof, both ends and one side of each of high cube box shipping containers are removed prior to assembly. The high cube box shipping containers can be altered to the form for assembly (i.e., the roof, both ends and one side of each of high cube box shipping containers are removed) before or after the high cube box shipping containers are shipped to the building site. Where the high cube box shipping containers are altered at the building site, the shipping containers can be used to store and ship various components of the building to be assembled or modified including but not limited to piping, roofing shingles, wood planks, staircases, ducting, wiring, etc.

In a preferred form, one or more high cube box shipping containers are connected to one or more flat racks to form one or more levels of a main structure (e.g., structural shell or frame) of a building structure. Different sized flat racks can be used including a flat rack having an 8 ft width, 2 ft height and a 40 ft length or a flat rack having an 8 ft width, 1 ft height and a 40 ft length. The use of the combination of shipping containers and flat racks allows the width of the building structure to be readily varied. For example, the main structure of one level of a shell or frame of a building structure is formed in part by two shipping containers forming opposing side portions of the level and one or more flat racks disposed between the opposing shipping containers. The shipping containers are preferably structurally connected by one or more cross-beams extending through corresponding fork-lift receiving pocket or channel of a corresponding flat rack. Like the containers and the flat racks, the cross-beams are preferably formed from metal (e.g., steel). The spacing between the flat racks and each of the shipping containers can be varied by adjusting the length of the cross-beams and by varying the distance between the flat racks and each of the shipping containers. By varying the spacing between the flat racks and corresponding shipping containers one can readily and easily adjust the width of the building structure. In addition, two or more sets of flat racks can be used between opposing shipping containers to readily and easily adjust the width of the building structure. One or more cross-beams extending through the fork-lift receiving pockets or channels of each flat rack in the two or more sets of flat racks can be used to structurally connect each of the flat racks to the corresponding shipping containers.

FIGS. 1, 1A to 1G, 2 and 2A to 2R

Figure 1A:
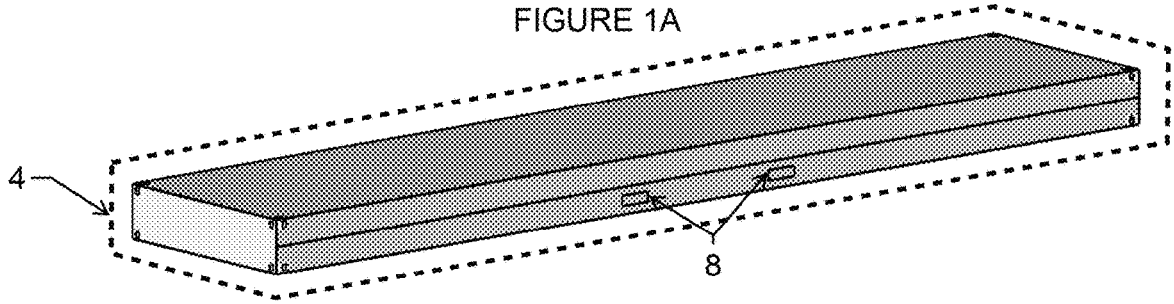
FIG. 1A is a perspective view of another preferred core or main building structure forming member.
Figure 1B:
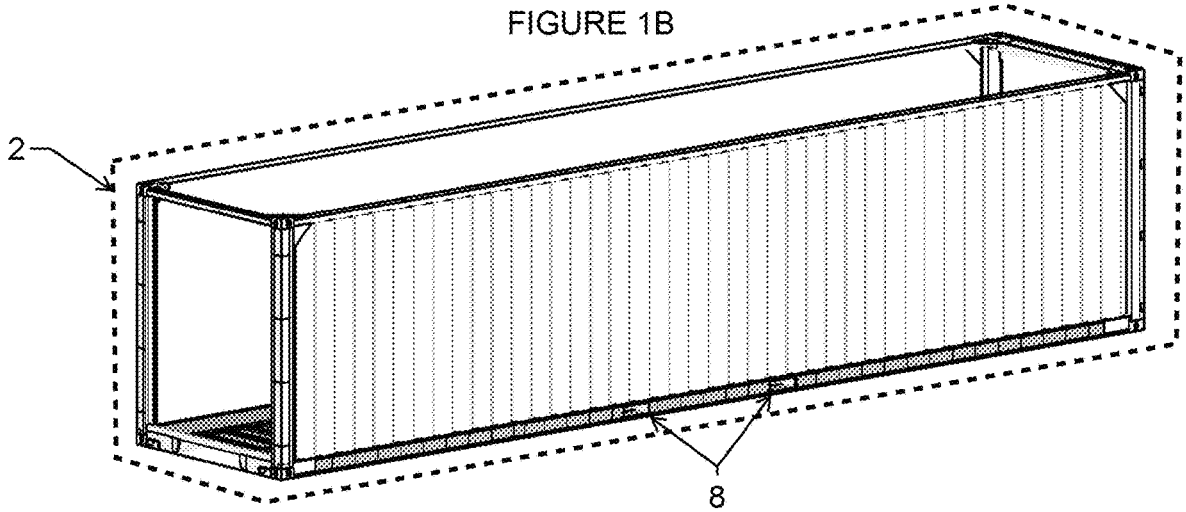
FIG. 1B is a perspective view of a further preferred core or main building structure forming member.
Figure 1C:
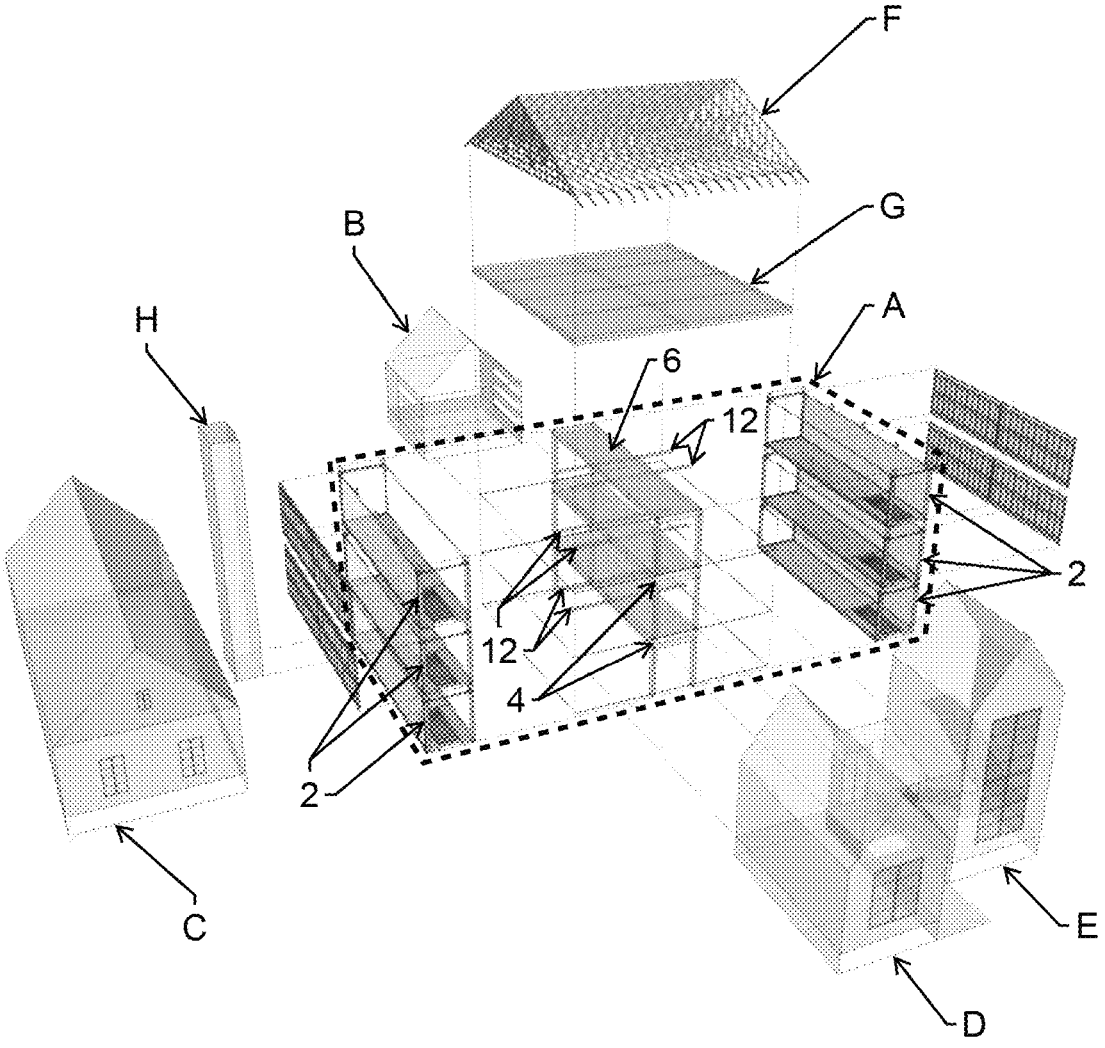
FIG. 1C is an exploded view of an example of a building structural system as well as component examples, configured according to the principles of the disclosure.
Figure 1D:
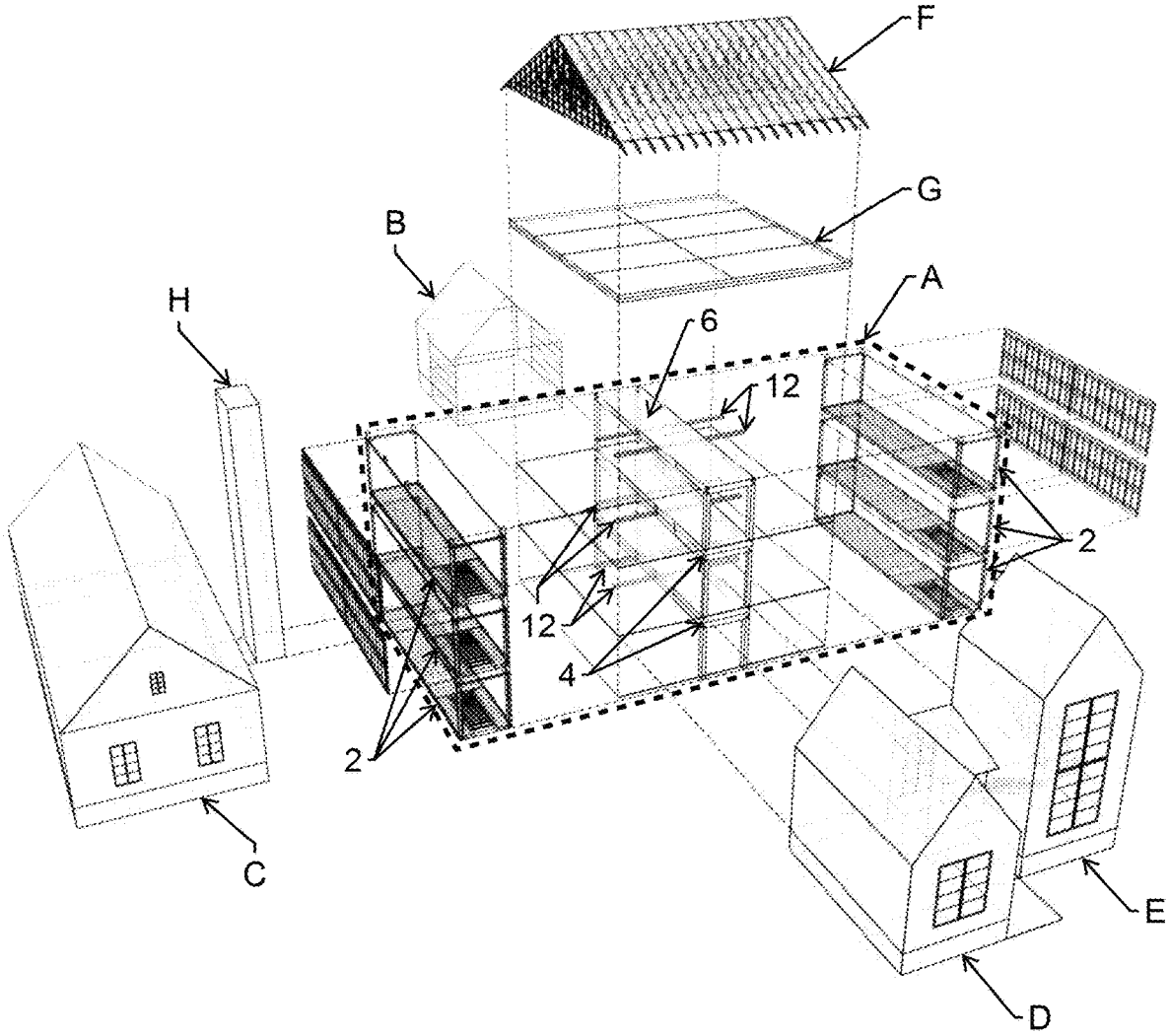
FIG. 1D is also an exploded view similar to FIG. 1C with graphical modifications for purposes of clarity only.

Referring to FIGS. 1, 1A to 1G, 2 and 2A to 2R, one of numerous possible configurations for a main structure (e.g., structural shell or frame) of a building structure will be described. Referring to FIGS. 1C and 1D, an exploded view of a main structure A along with various exemplary building structures B, C, D and E that can be formed using preferred forms of the invention and additional building structure components F, G and H. While several exemplary building structures are depicted, the subject invention is not limited to those depicted as numerous other configurations are possible using the scalable, compatible and resilient building systems, elements of the systems and corresponding methods of construction. A roofing frame or skeleton F can be made out of any suitable material including wood, metal or a combination thereof and can be supported on roof support G that again can be formed from any suitable material including wood, metal or a combination thereof. Chimney H is just one of many possible complementary elements/members/structures that can be used with main structure A.

Figure 1E:
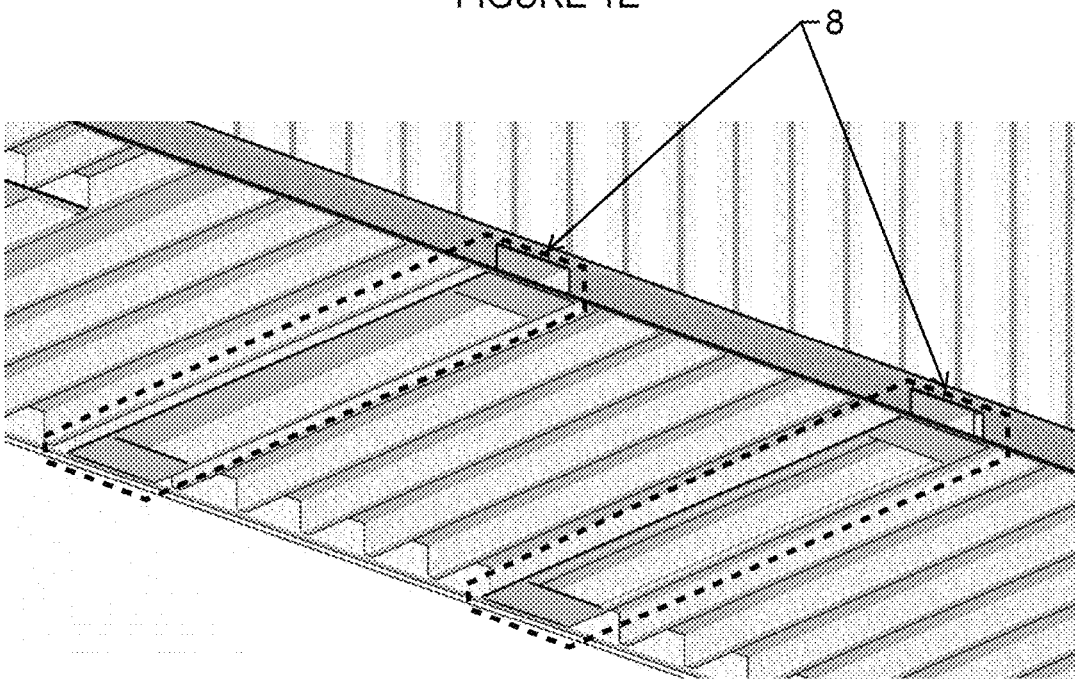
FIG. 1E is a fragmentary perspective view of a section of the preferred core or main building structure forming member depicted in FIG. 1B.
Figure 1F:
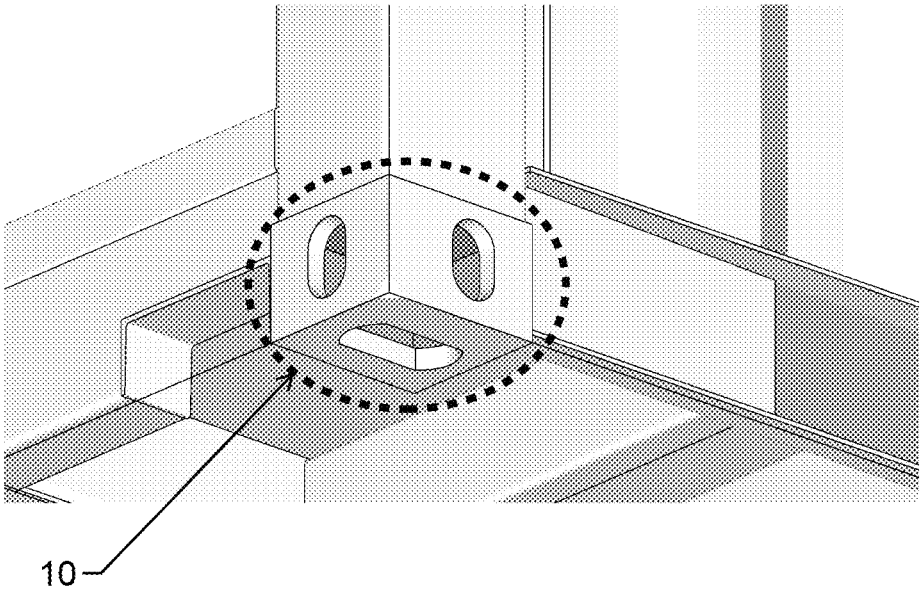
FIG. 1F is a fragmentary perspective view of another section of the preferred core or main building structure forming member depicted in FIG. 1B.
Figure 1G:
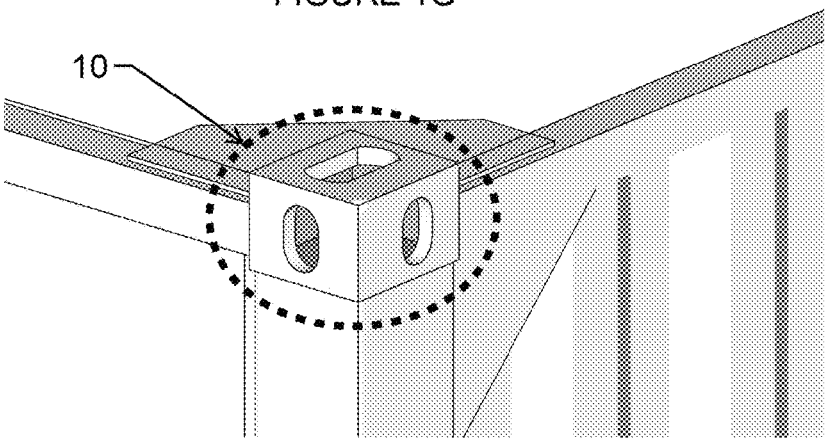
FIG. 1G is a fragmentary perspective view of a further section of the preferred core or main building structure forming member depicted in FIG. 1B.

FIGS. 1, 1A and 1B illustrate the core or primary members, elements or structures that are utilized to form main structure or assembly A. FIG. 1, illustrates a preferred flat rack 6 having an 8 ft width, 1 ft height and a 40 ft length. Fork-lift receiving pockets or channels 8 extend through a mid-section of flat rack 6 so that a fork-lift can lift the flat rack 6 from either side of the flat rack 6. Preferably, each of the four upper and lower corners of the flat rack 6 includes a corner casting 10 of the type illustrated in FIGS. 1F and 1G. FIG. 1A, illustrates a preferred flat rack 4 having an 8 ft width, 2 ft height and a 40 ft length. Fork-lift receiving pockets or channels 8 extend through a mid-section of flat rack 4 so that a fork-lift can lift the flat rack 4 from either side of the flat rack 4. Preferably, each of the four upper and lower corners of the flat rack 4 includes a corner casting 10 of the type illustrated in FIGS. 1F and 1G. FIG. 1B, illustrates a preferred high cube box shipping container 2 having an 8 ft width, 9.5 ft height and a 40 ft length. Fork-lift receiving pockets or channels 8 extend through a mid-section of shipping container 2 so that a fork-lift can lift the shipping container 2 from either side of the shipping container 2. Preferably, each of the four upper corners and four lower corners of the shipping container 2 includes a corner casting 10 of the type illustrated in FIGS. 1F and 1G, i.e., all corner castings of shipping container are preferably identical. Similarly, it is preferred that the eight corner castings of each of the flat racks 4 and 6 are identical. FIG. 1E is an enlarged viewing showing, inter alia, the fork-lift receiving pockets or channels 8 extending through a mid-section of shipping container 2.

Figure 2:
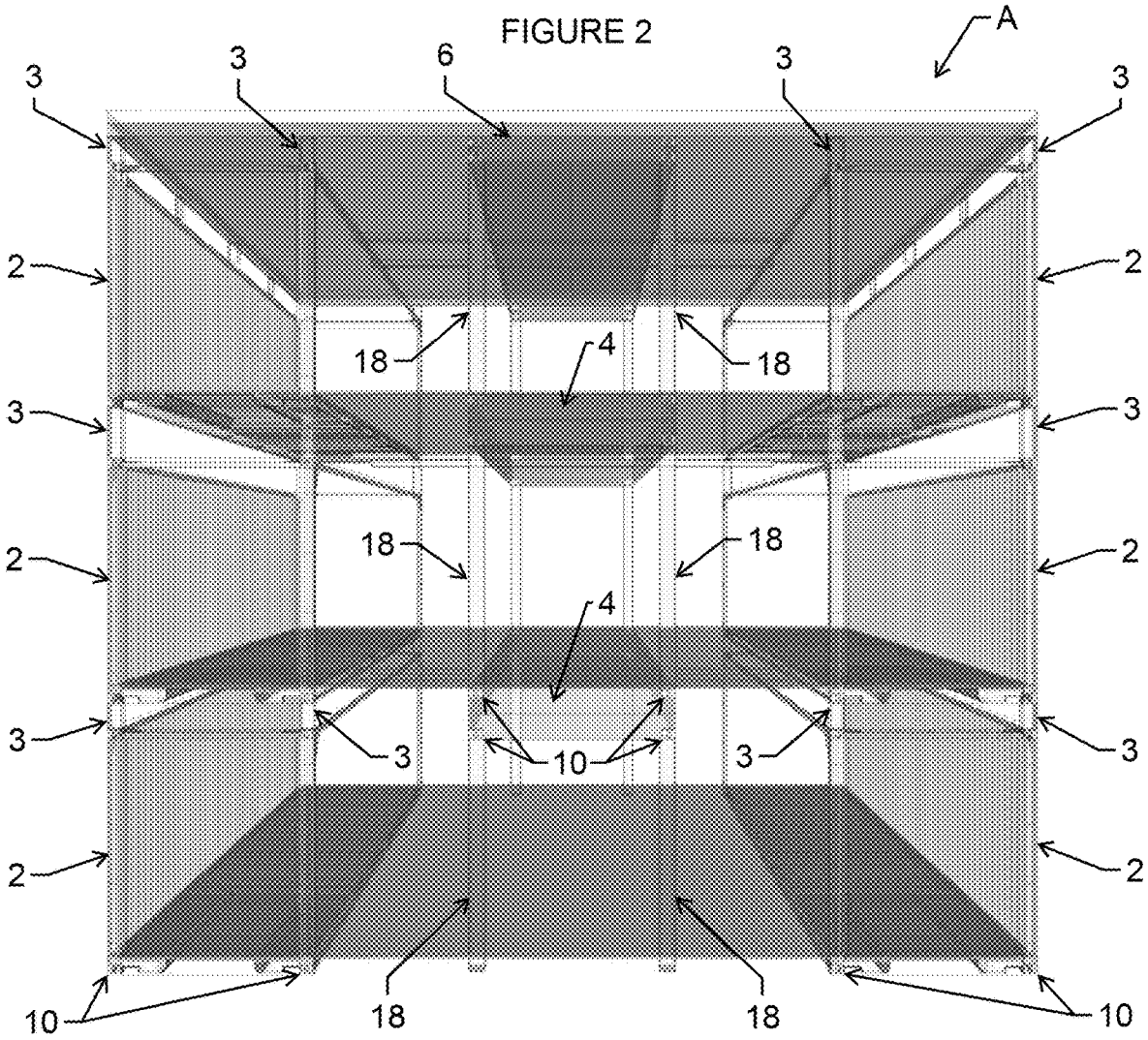
FIG. 2 is a front perspective view of an example of a preferred building structural system with two columns of stacked box containers and one central column of stacked flat racks, configured according to a preferred embodiment forming a main structural frame or structural assembly of a building structure.
Figure 2A:
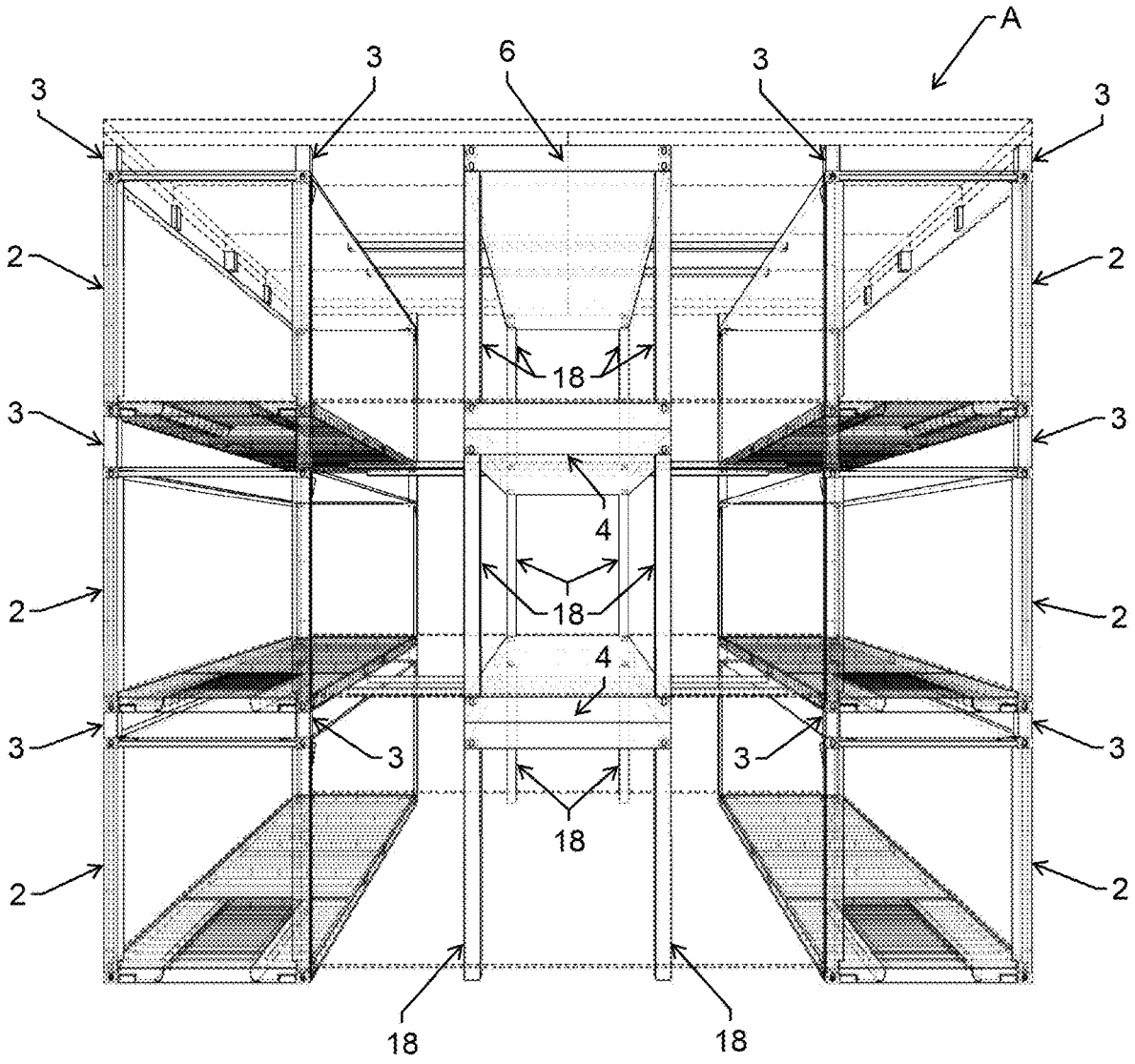
FIG. 2A is a front perspective view of the embodiment depicted in FIG. 2 with graphical modifications for purposes of clarity only.
Figure 2B:
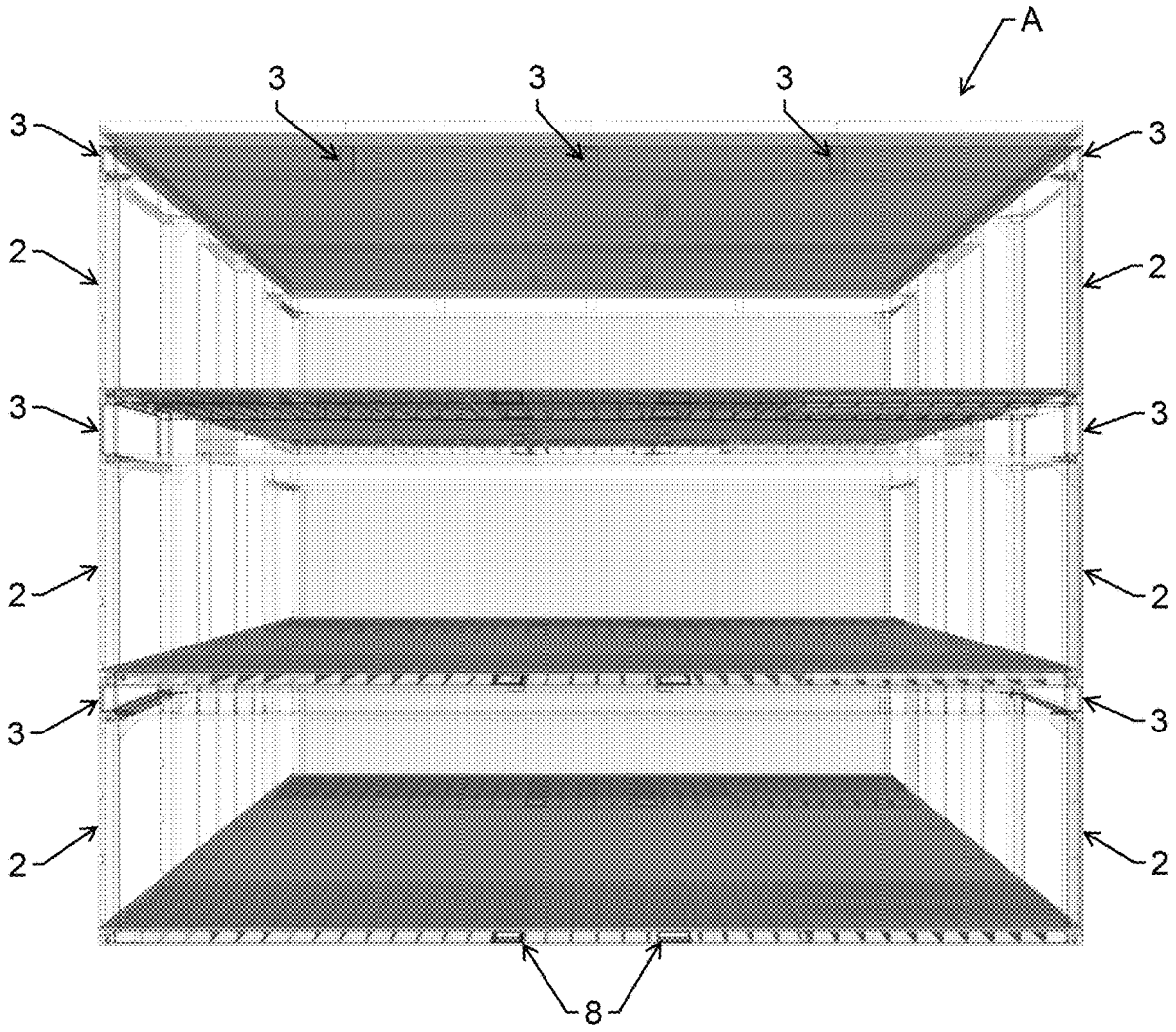
FIG. 2B is a side perspective view of the embodiment depicted in FIG. 2.
Figure 2C:
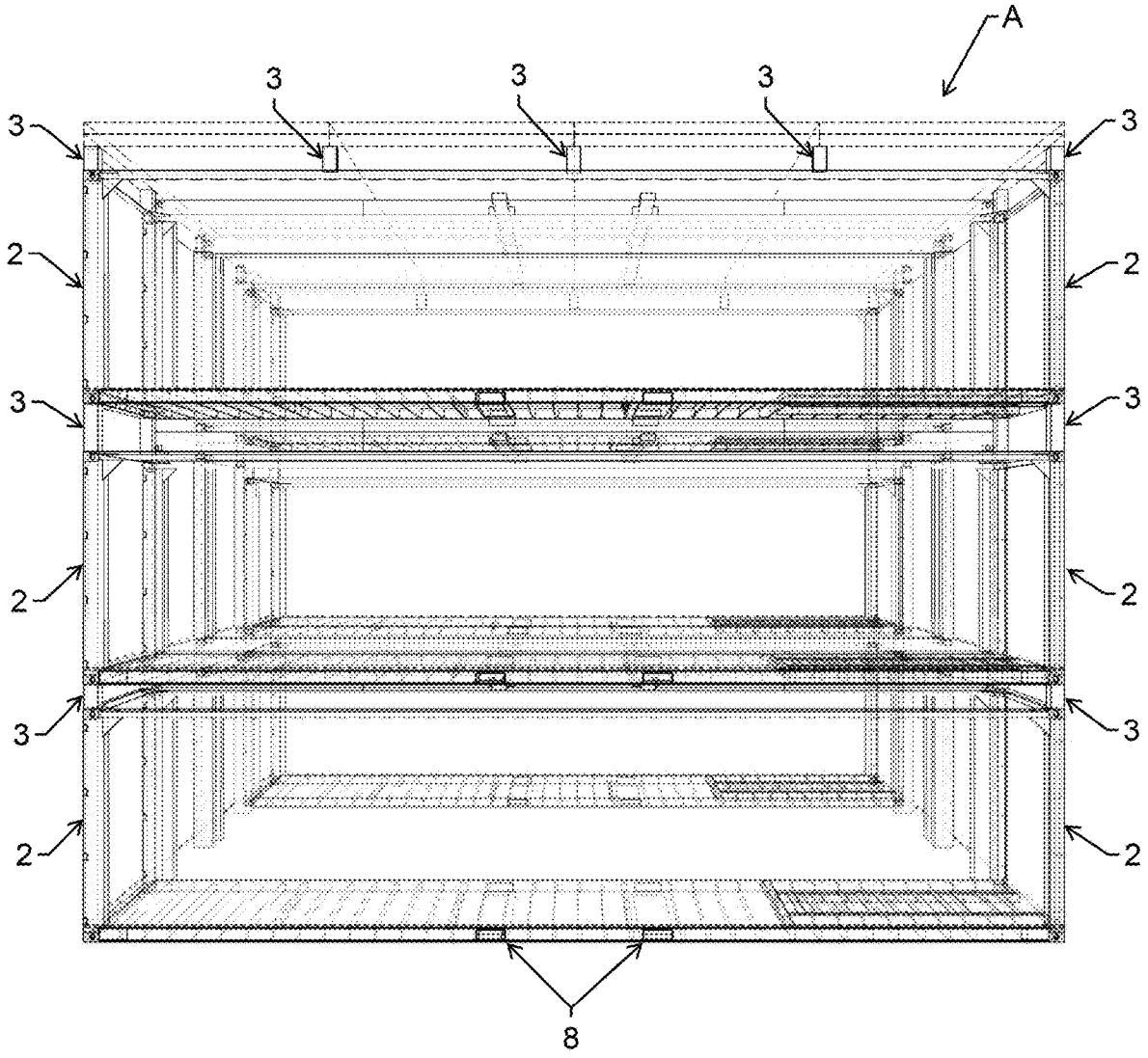
FIG. 2C is a side perspective view of the embodiment depicted in FIG. 2 with graphical modifications for purposes of clarity only.
Figure 2D:
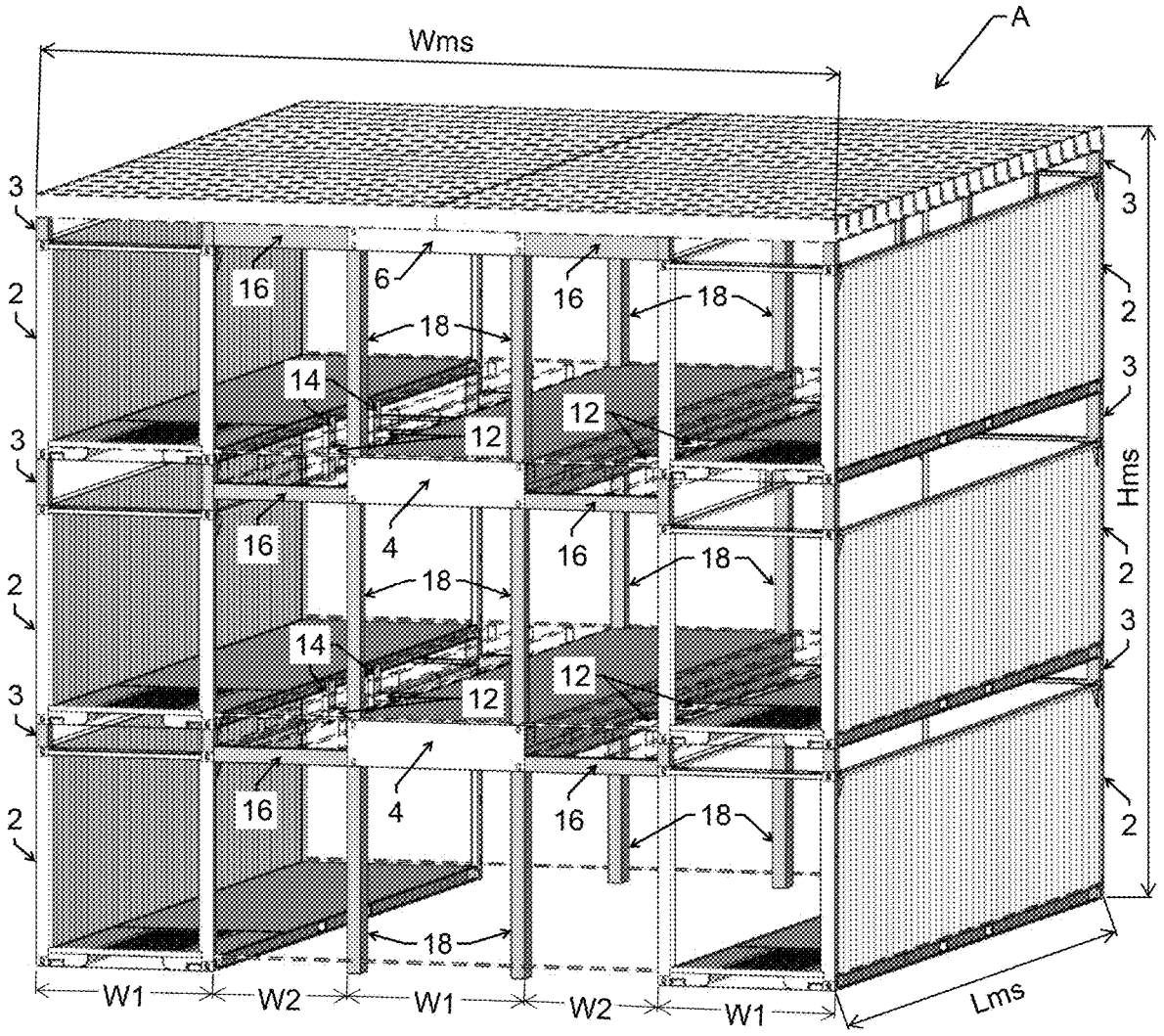
FIG. 2D is a perspective view of another example of a preferred building structural system similar to the embodiment depicted in FIG. 2 with portions thereof removed for purposes of clarity only.
Figure 2E:
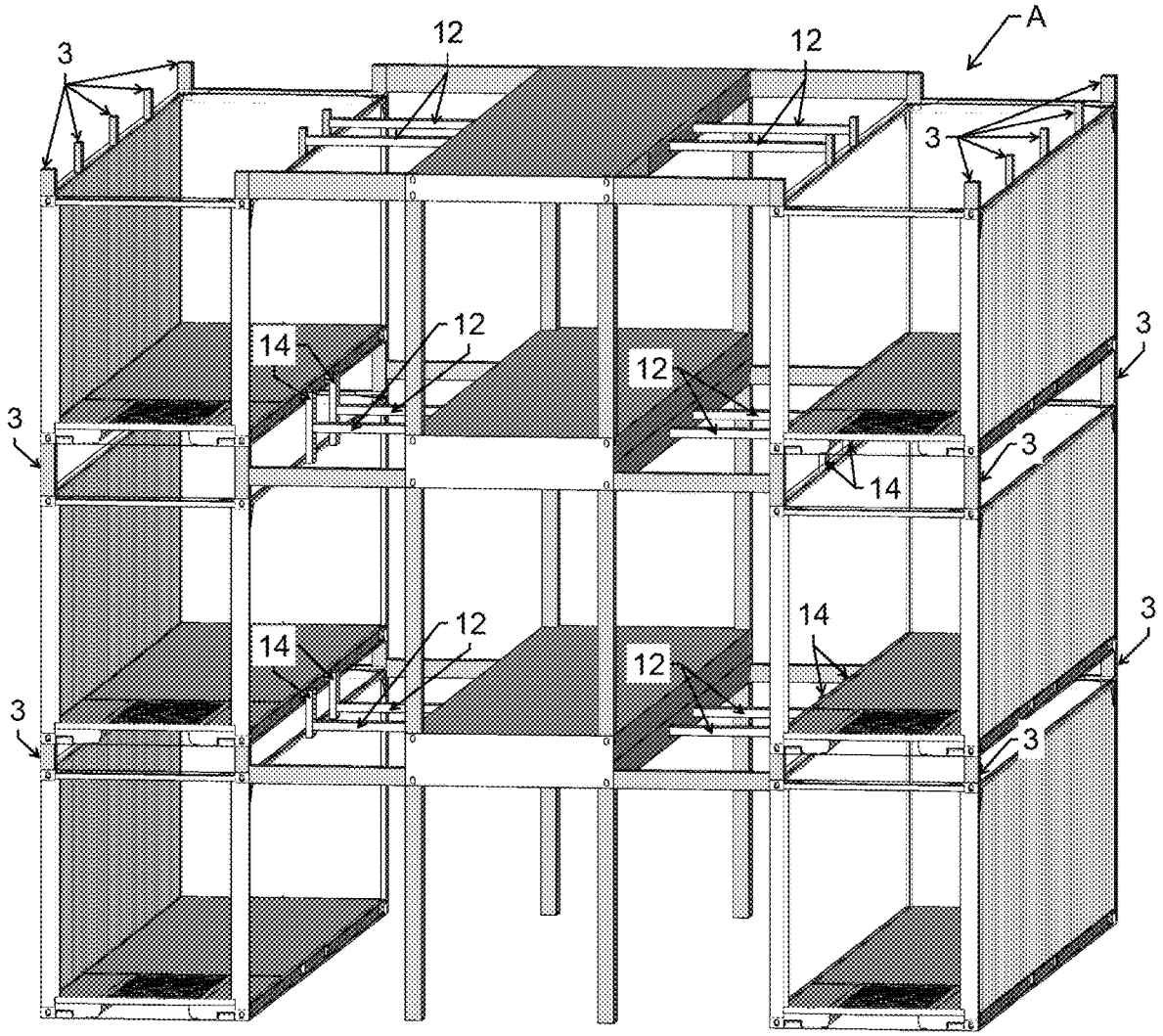
FIGS. 2E to 2R are views of portions of the embodiment illustrated in FIG. 2D.
Figure 2F:
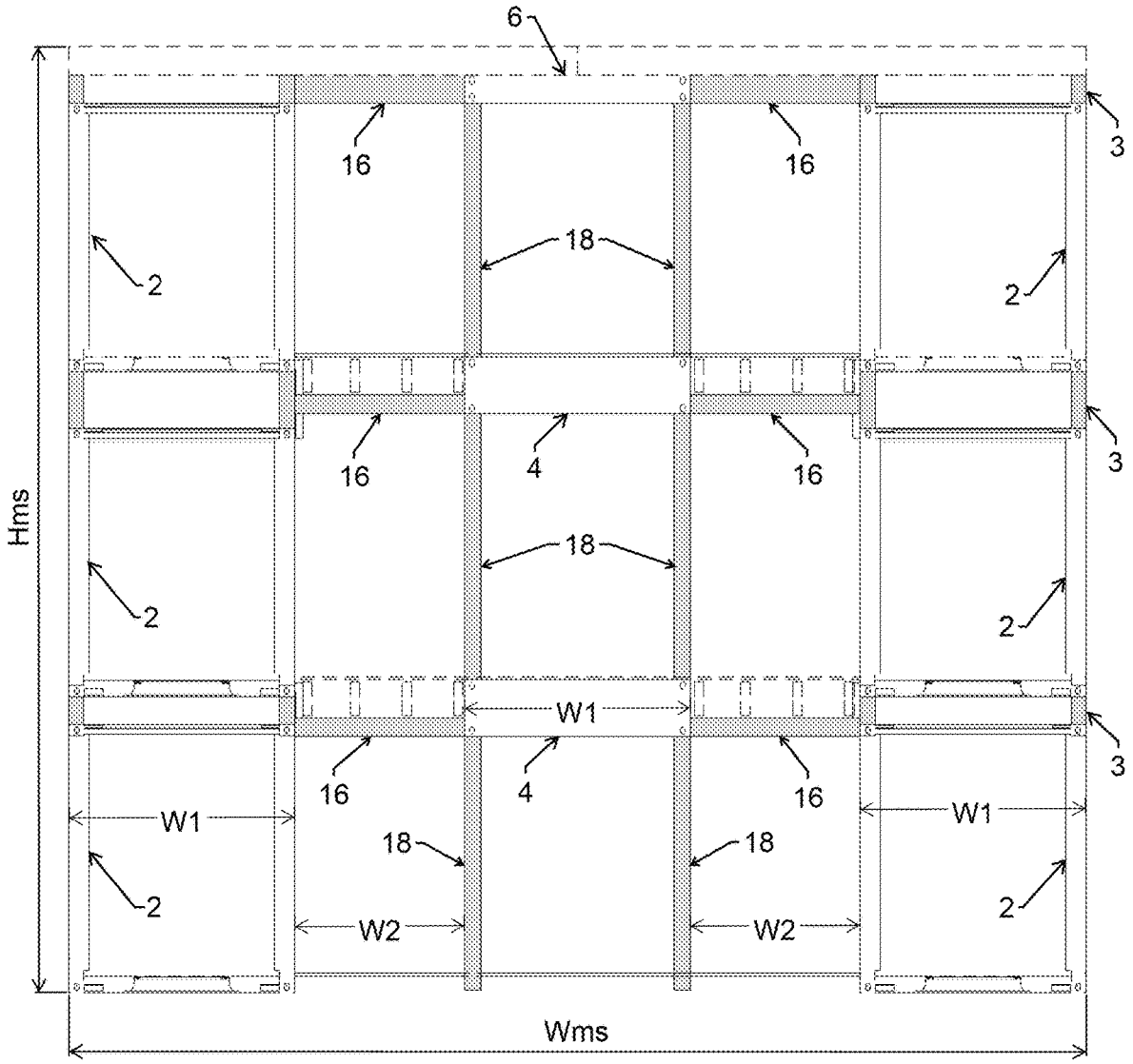
Figure 2G:
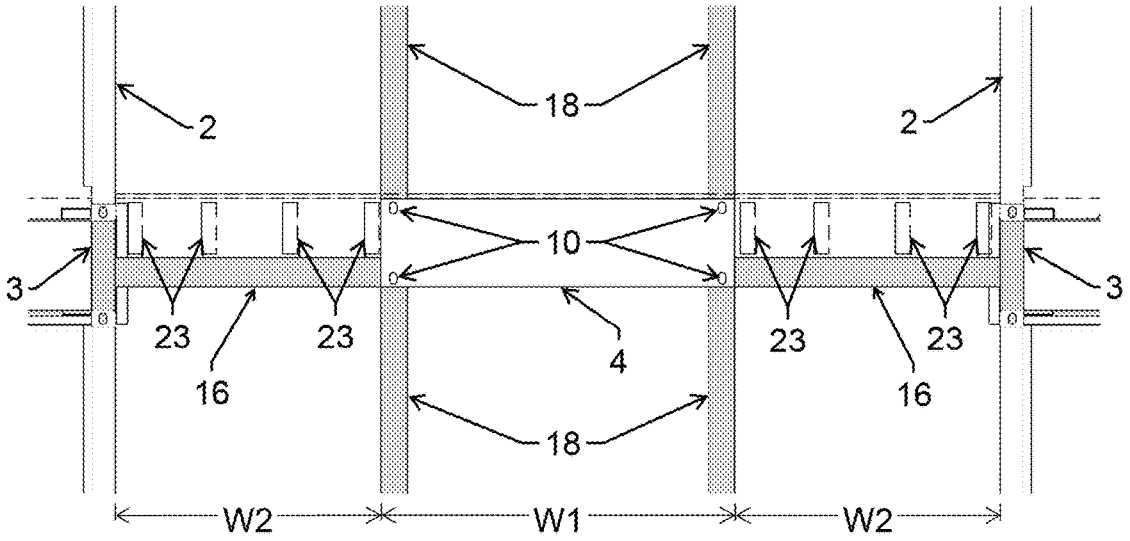
Figure 2H:
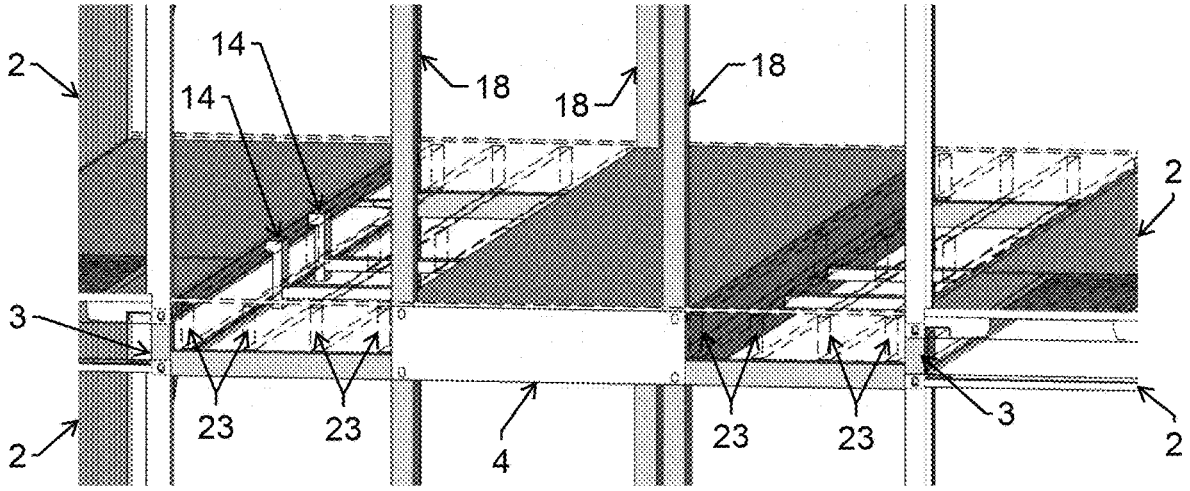
Figure 2I:
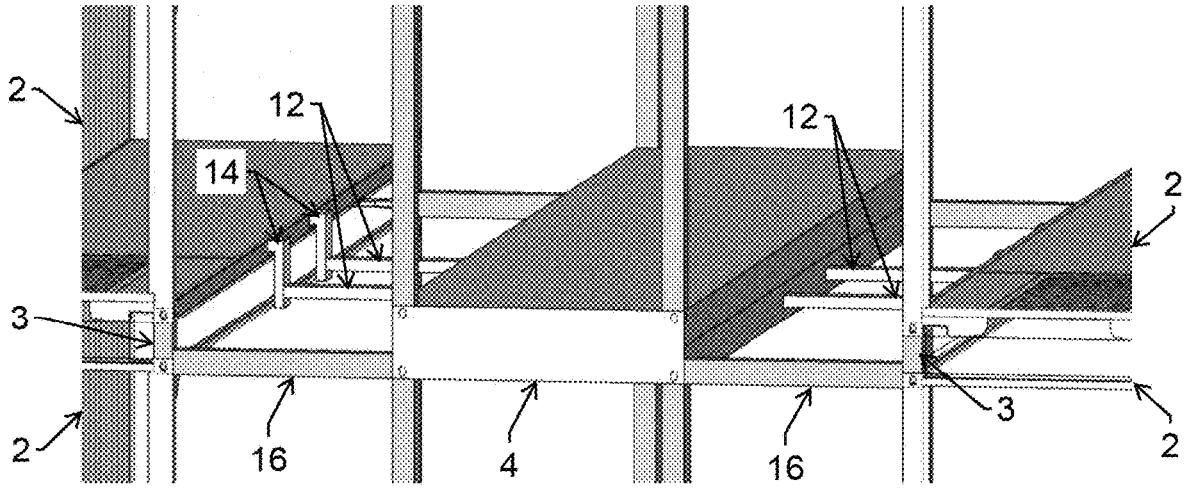
Figure 2J:
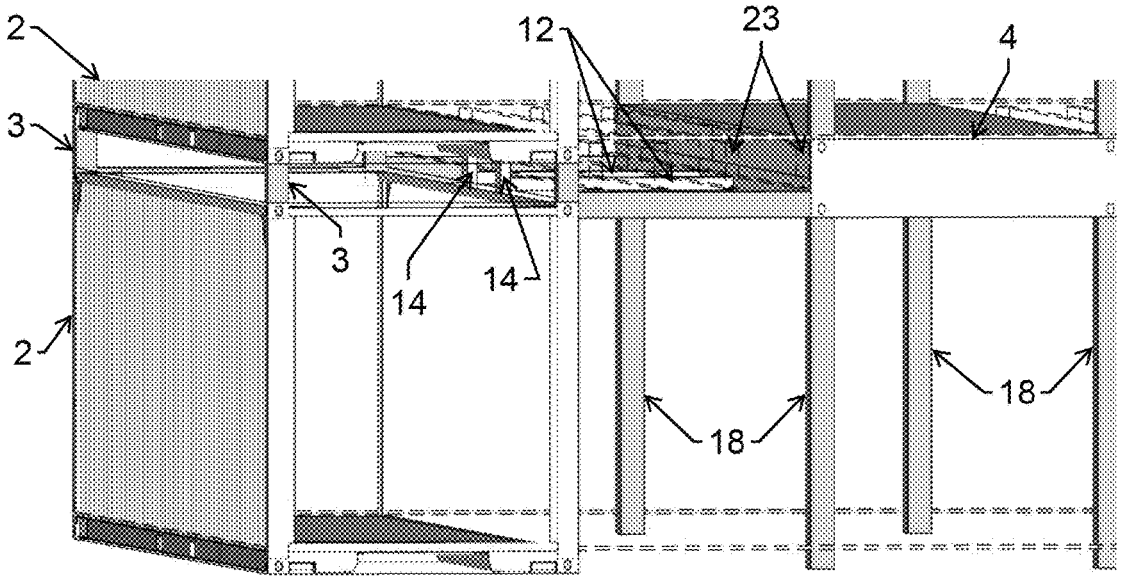
Figure 2K:
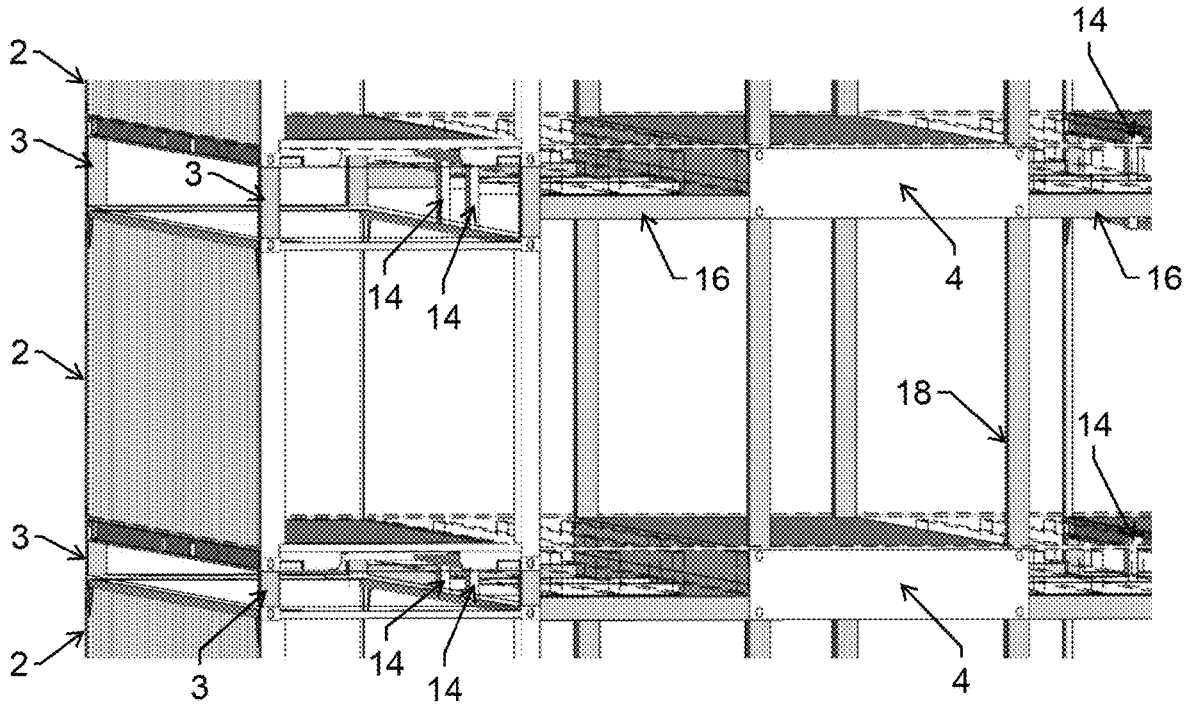
Figure 2L:
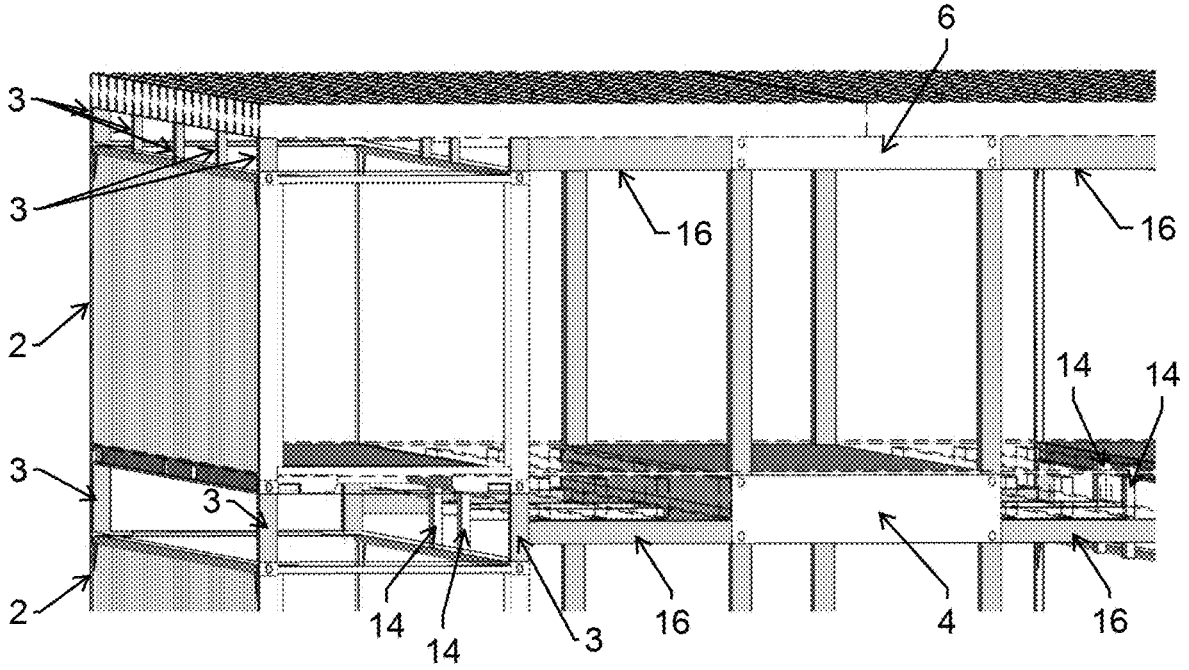
Figure 2M:
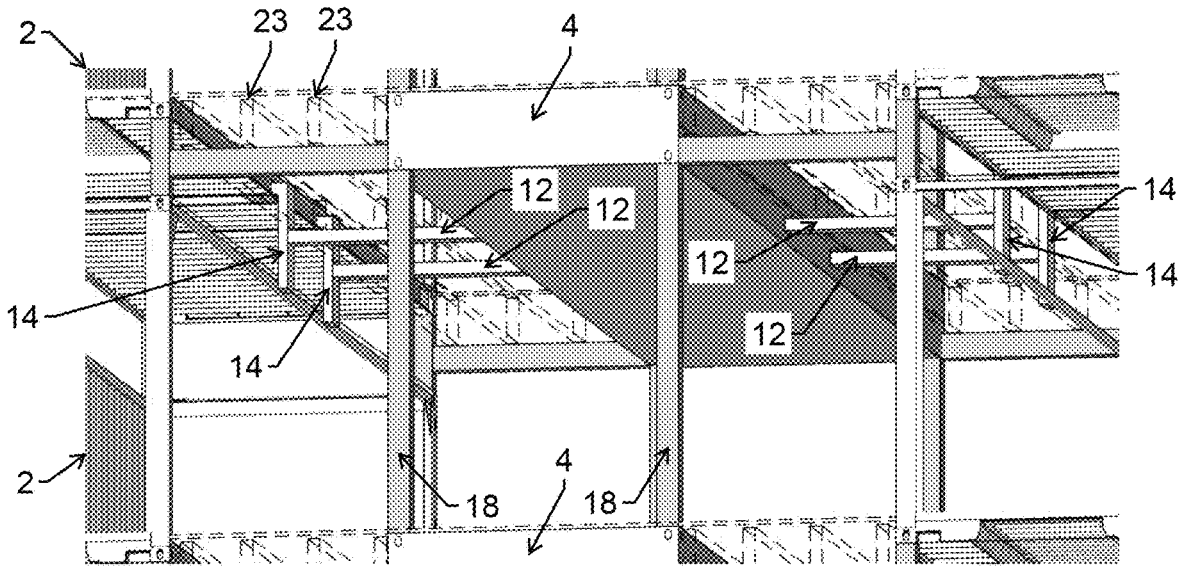
Figure 2N:
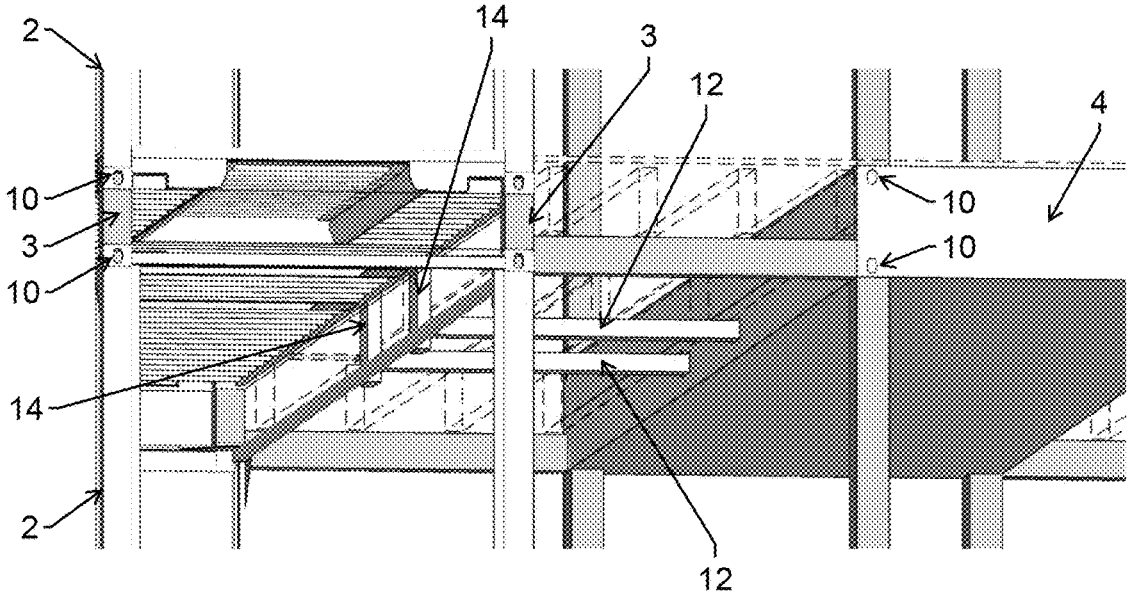
Figure 2O:
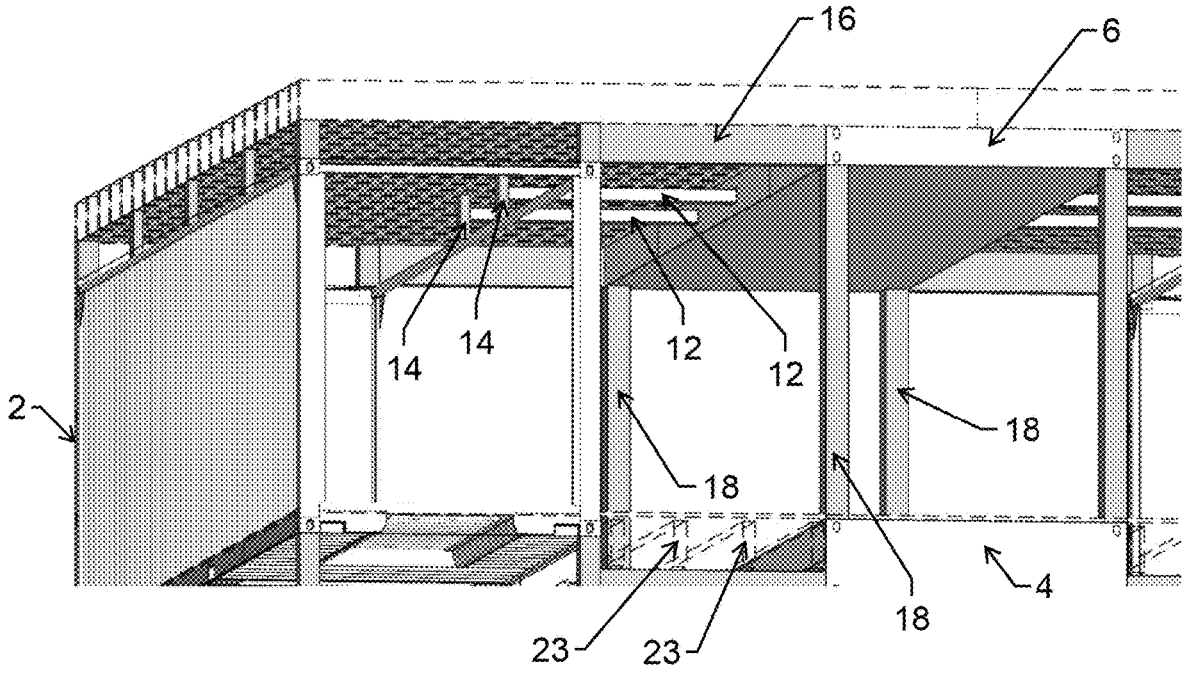
Figure 2P:
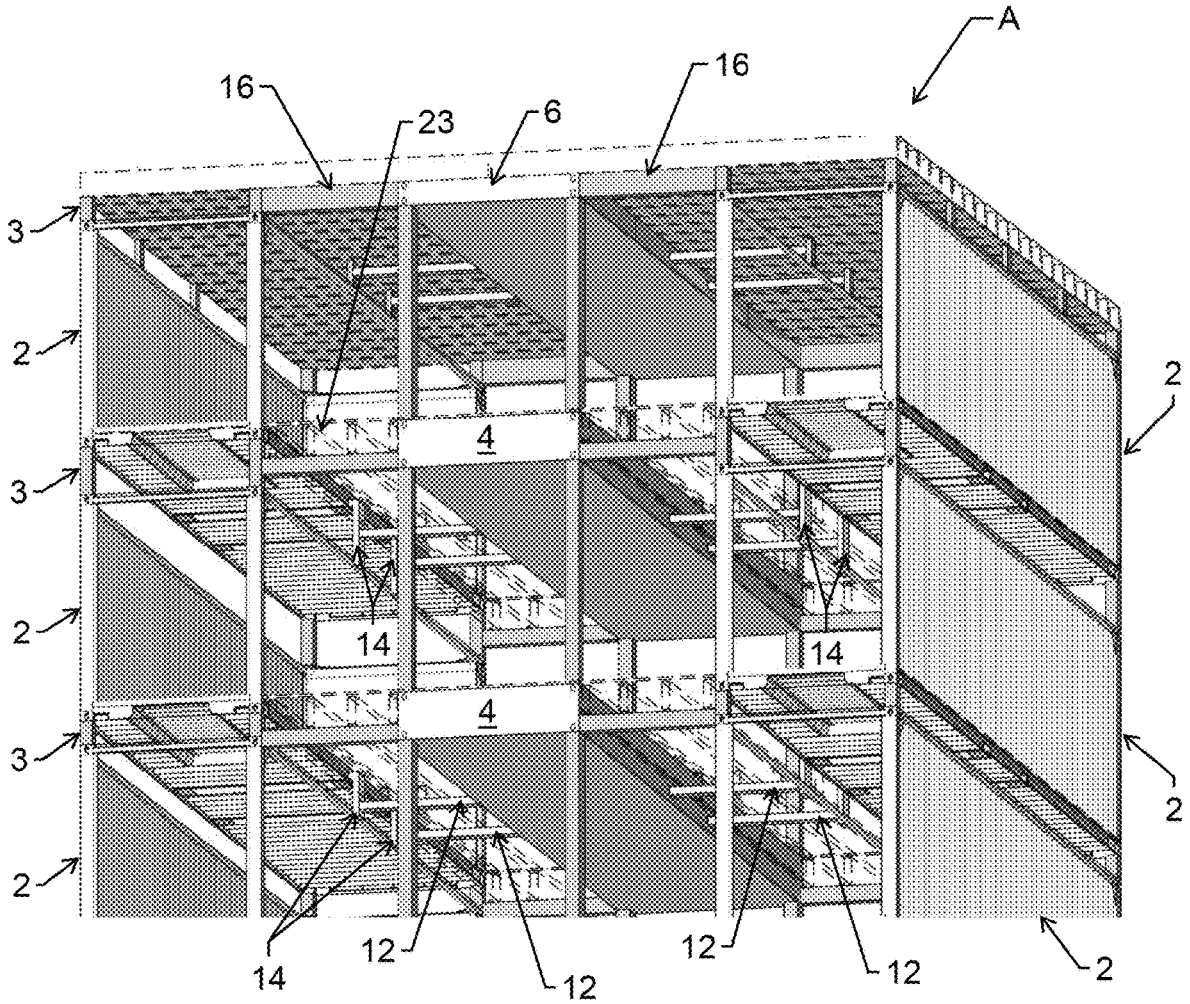
Figure 2Q:
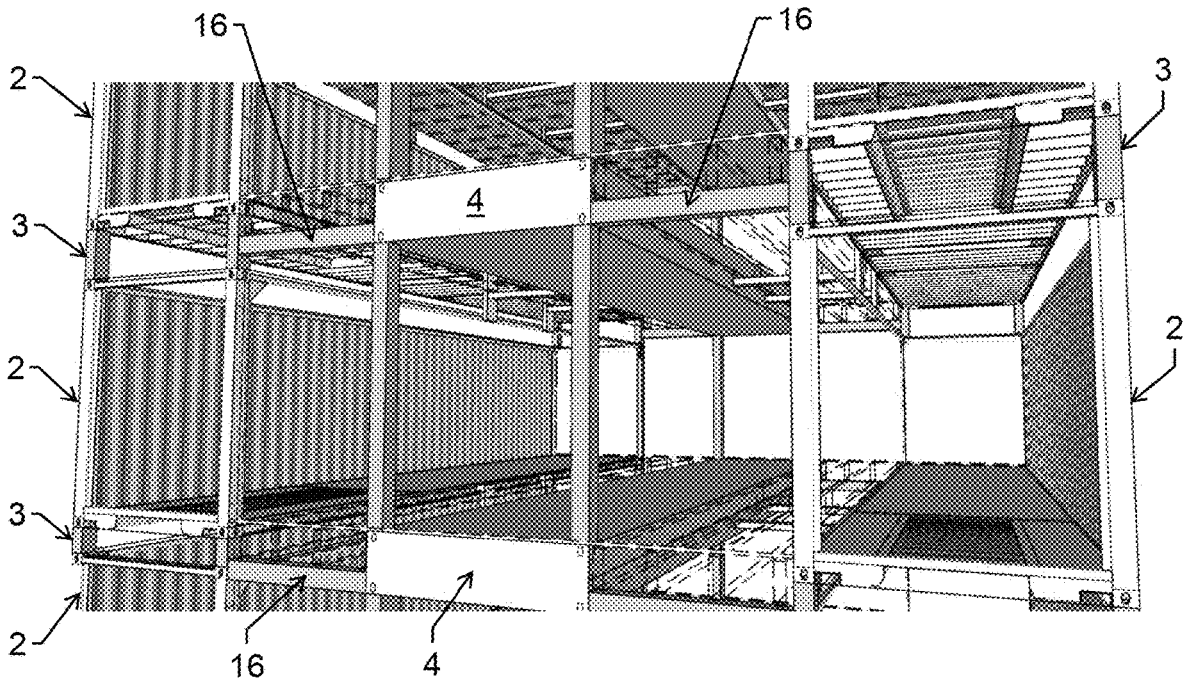
Figure 2R:
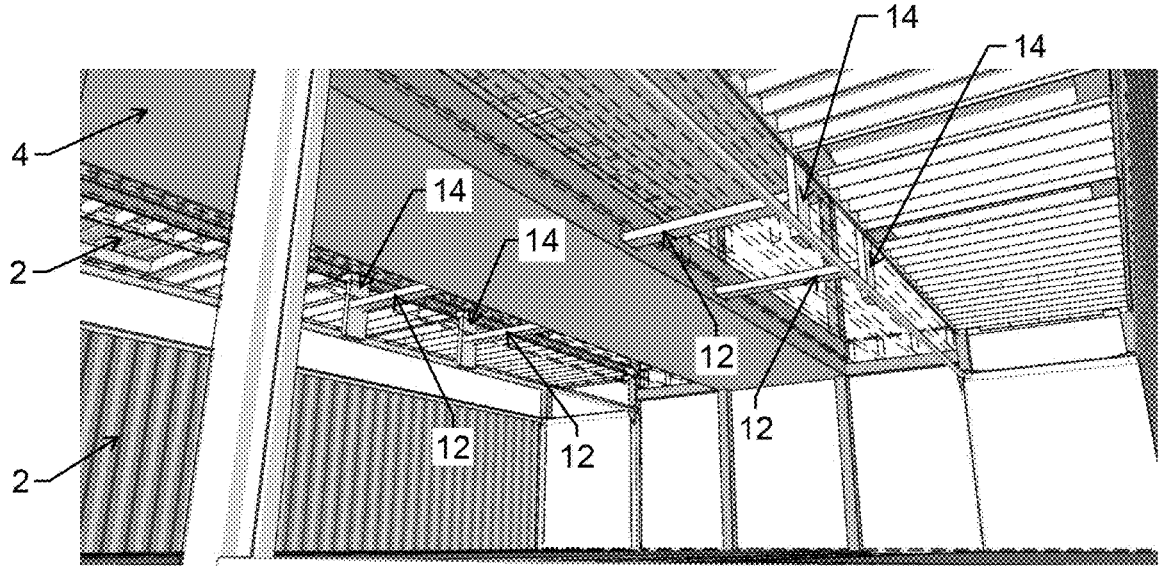
Figure 3:
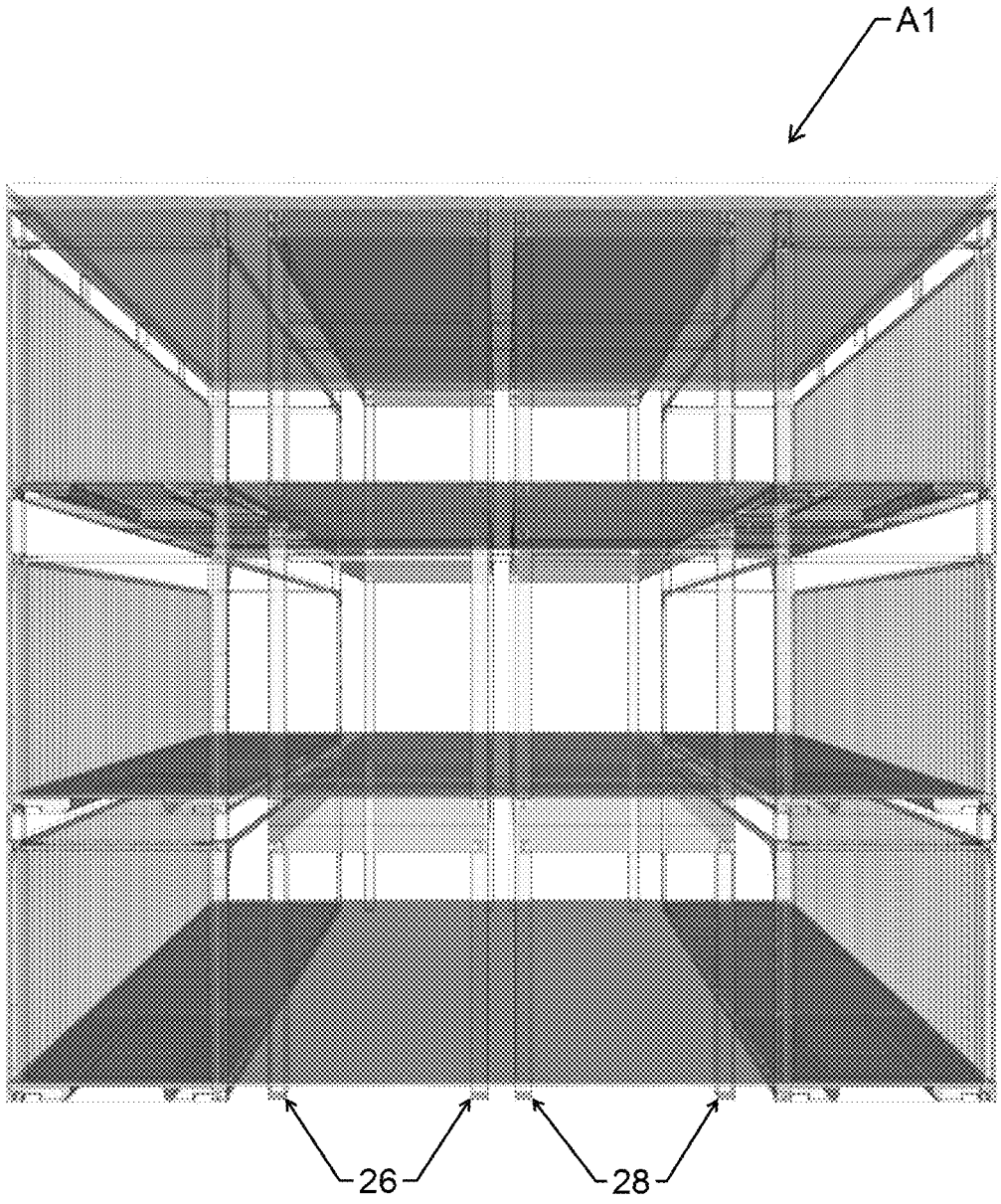
FIG. 3 is a front perspective view of a further example of a building structural system with two columns of stacked box containers and two central columns of stacked flat racks of another preferred embodiment forming a main structural frame or structural assembly of a building structure.
Figure 3A:
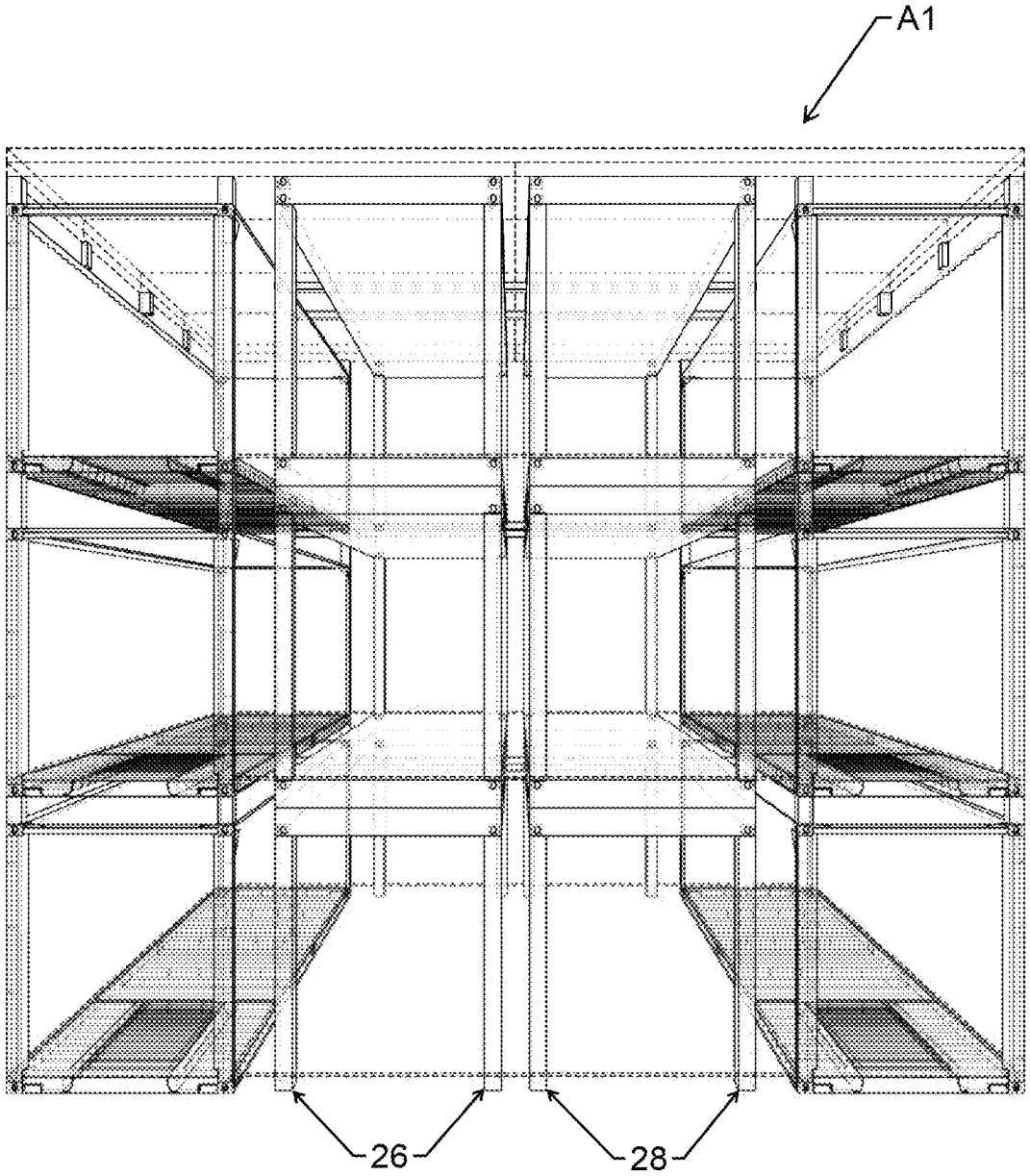
FIG. 3A is a front perspective view of the embodiment depicted in FIG. 3 with graphical modifications for purposes of clarity only.
Figure 3B:
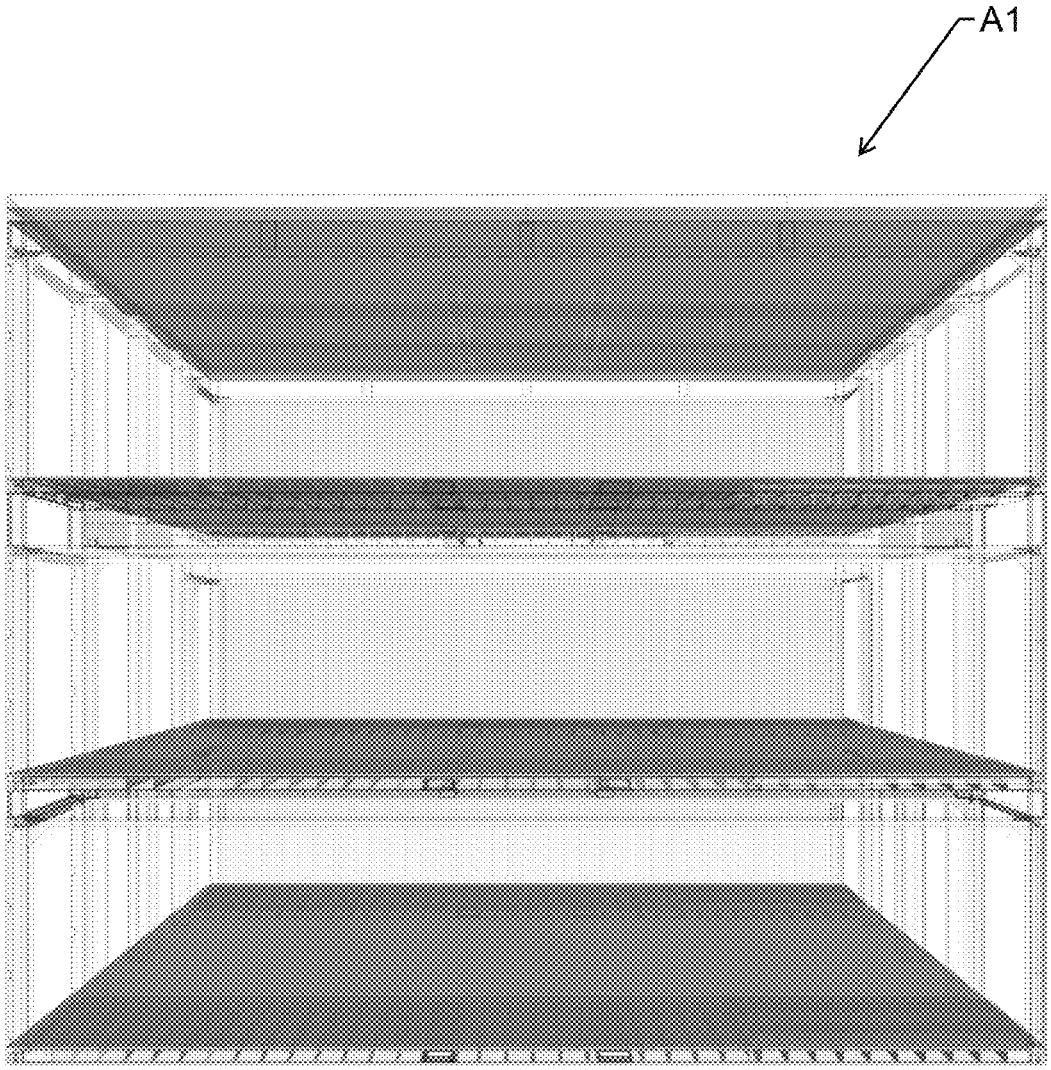
FIG. 3B is a side perspective view of the embodiment depicted in FIG. 3.
Figure 3C:
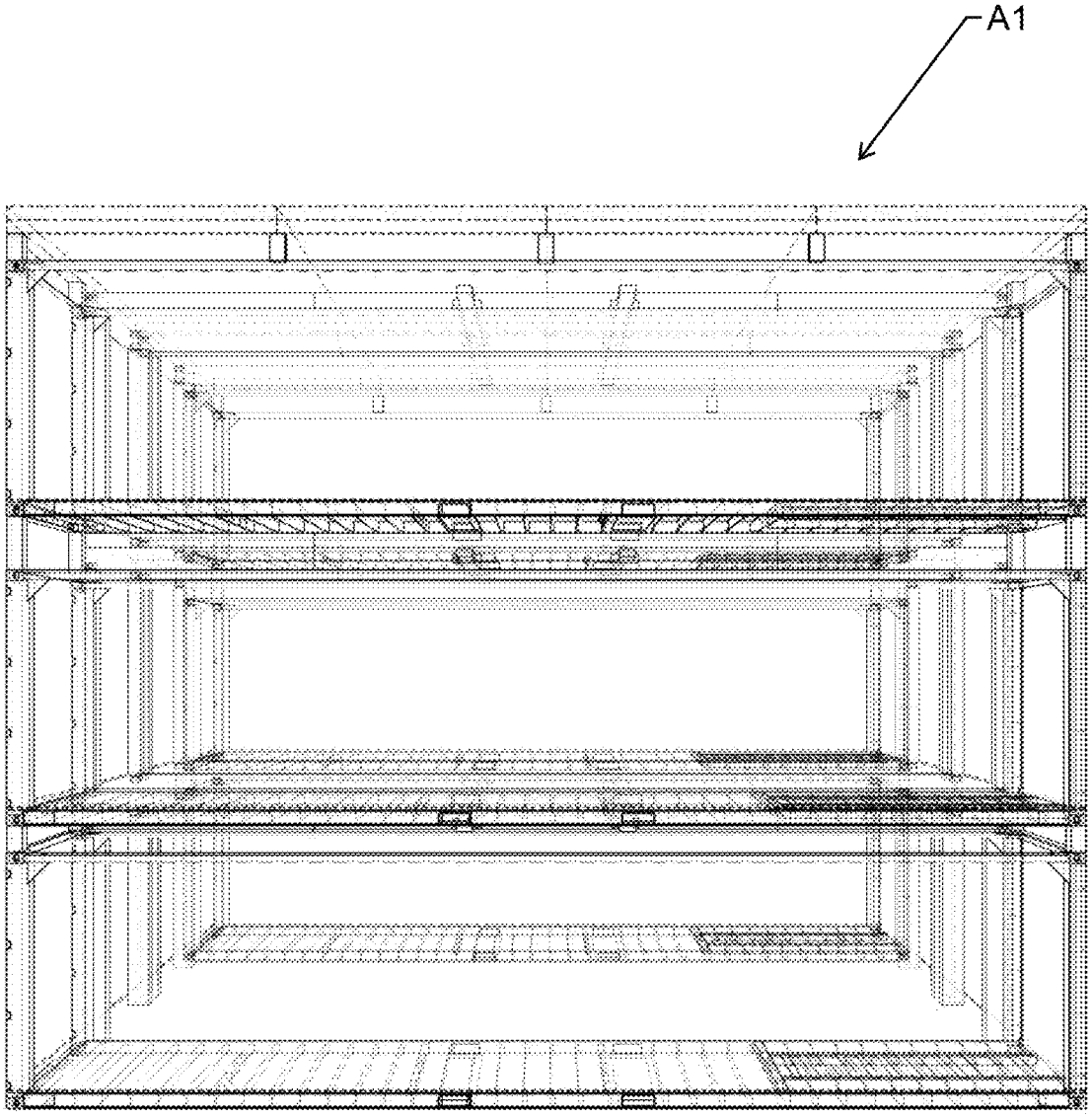
FIG. 3C is a side perspective view of the embodiment depicted in FIG. 3 with graphical modifications for purposes of clarity only.
Figure 4:
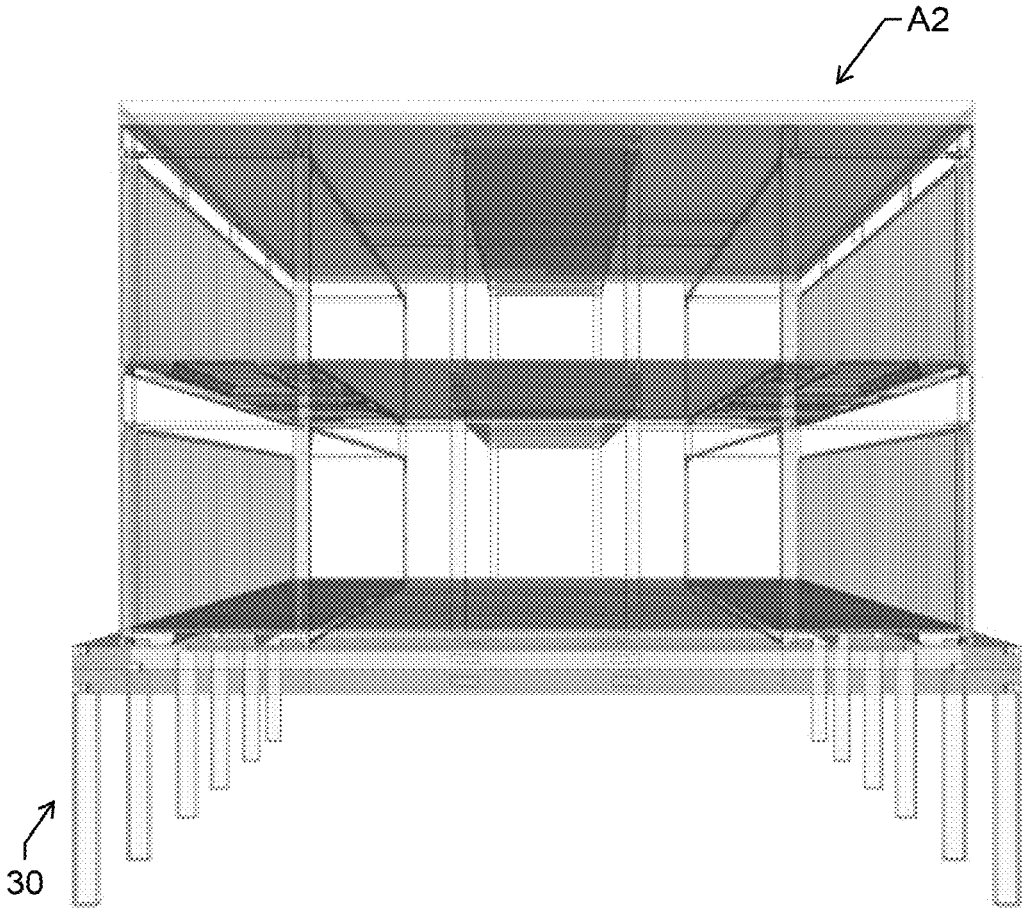
FIG. 4 is a front perspective view of a further embodiment of a building structural system with two columns of stacked box containers, one central column of stacked flat racks, and a rotated series of flat racks horizontally aligned as a base for supporting the aforementioned elements.
Figure 4A:
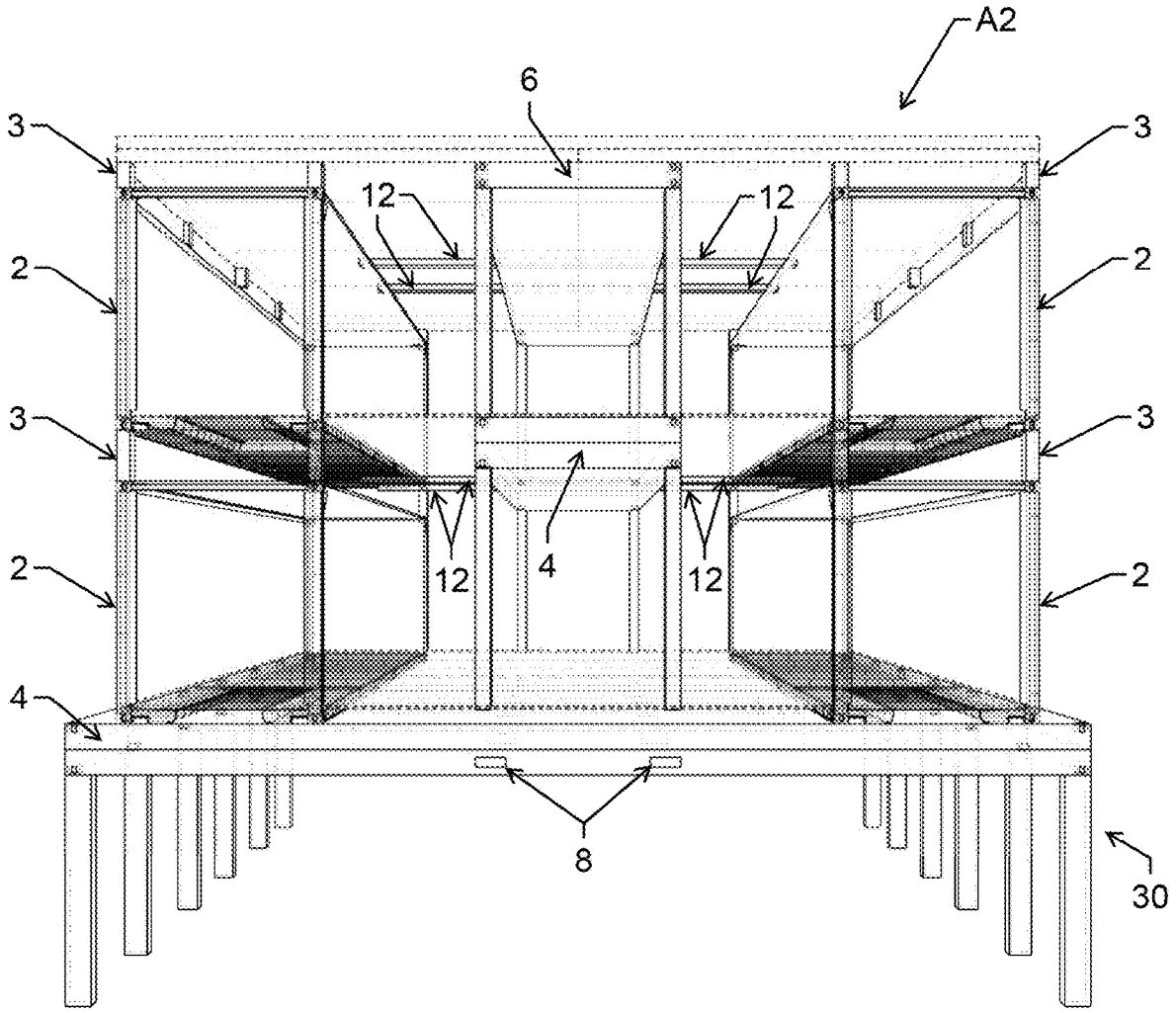
FIG. 4A is a front perspective view of the embodiment depicted in FIG. 4 with graphical modifications for purposes of clarity only.
Figure 4B:
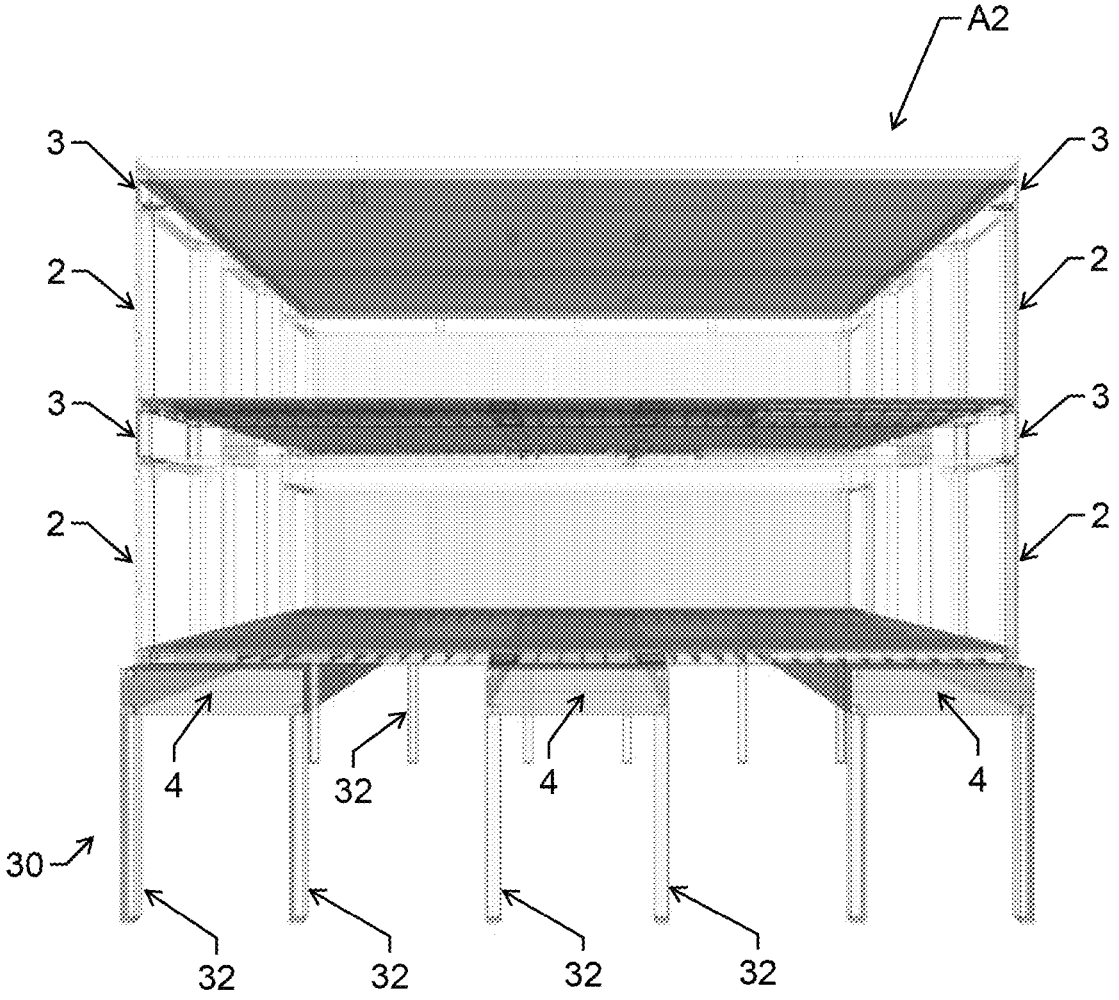
FIG. 4B is a side perspective view of the embodiment depicted in FIG. 4.
Figure 4C:
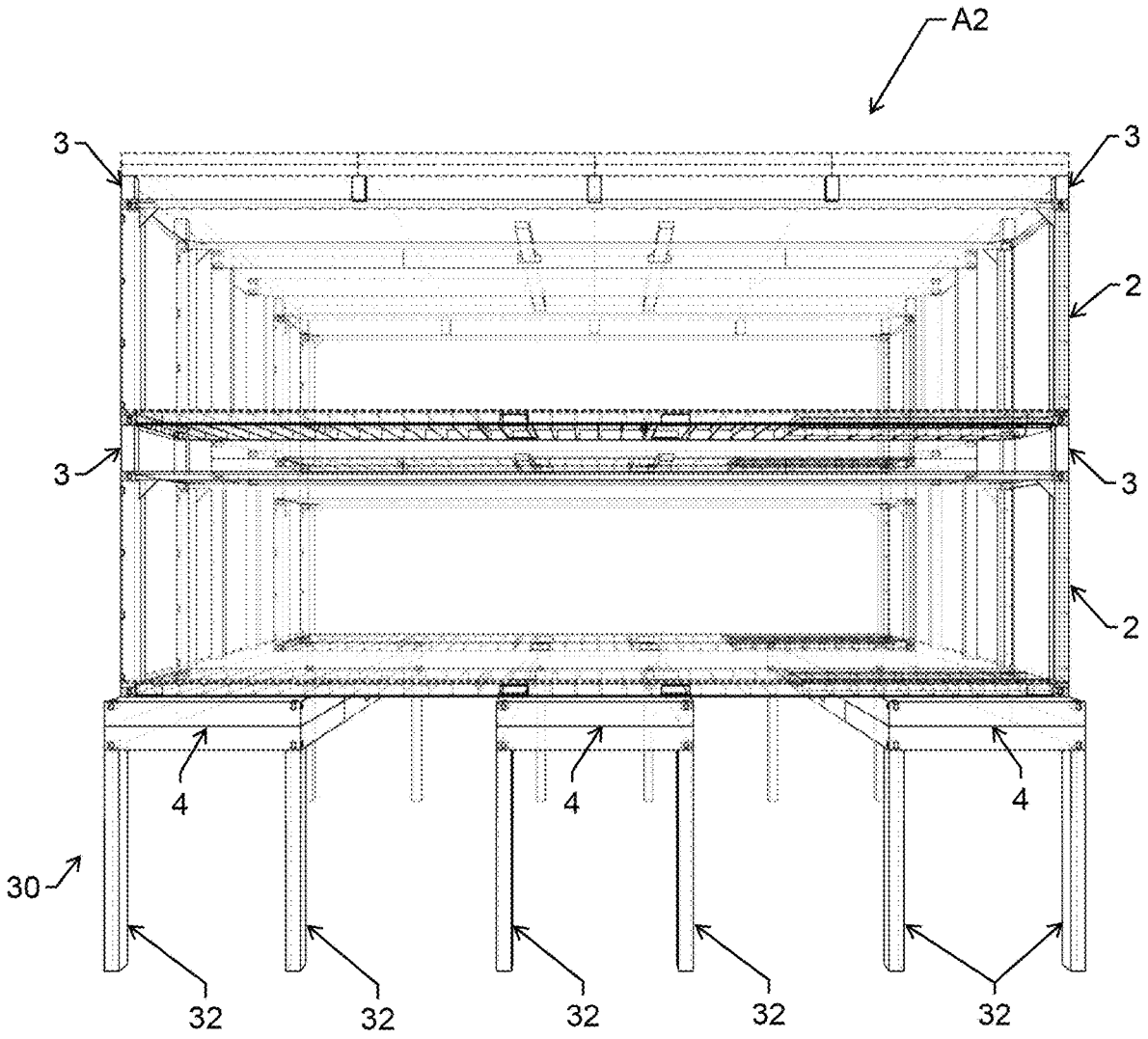
FIG. 4C is a side perspective view of the embodiment depicted in FIG. 4 with graphical modifications for purposes of clarity only.
Figure 5:
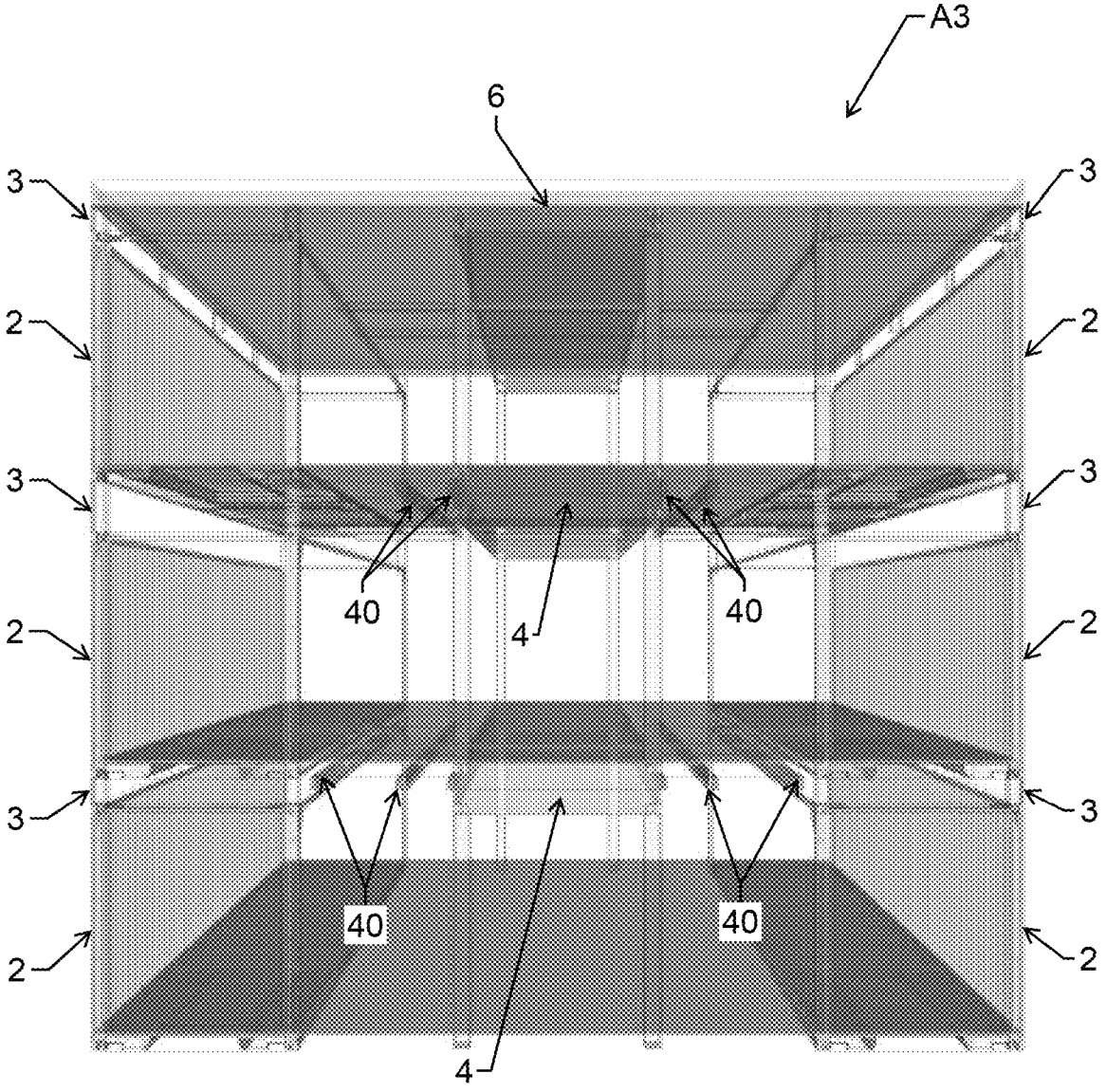
FIG. 5 is a front perspective view of a further embodiment of a building structural system with two columns of box containers, one central column of flat racks, and pallet rack elements.
Figure 5A:
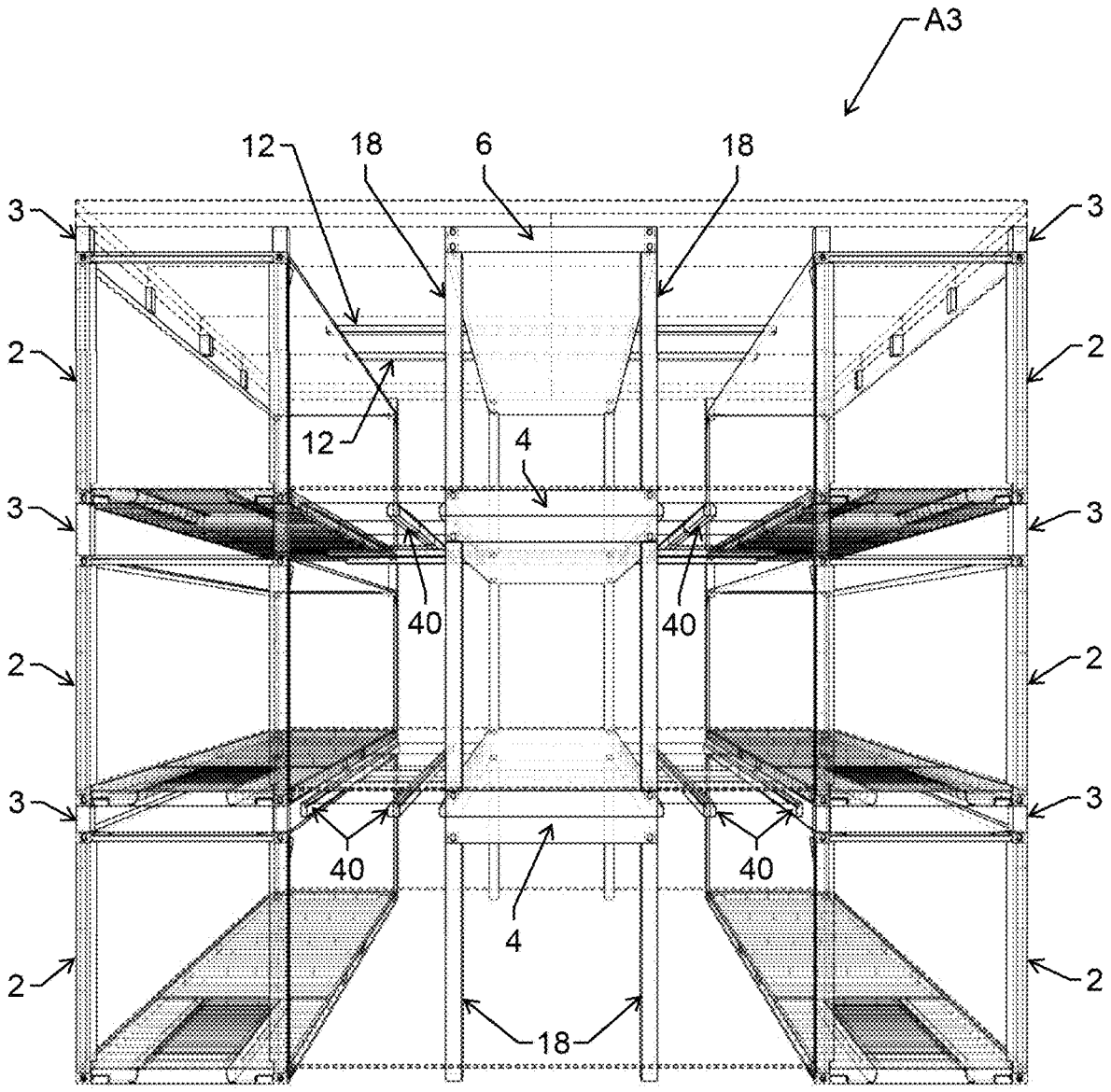
FIG. 5A is a front perspective view of the embodiment depicted in FIG. 5 with graphical modifications for purposes of clarity only.
Figure 5B:
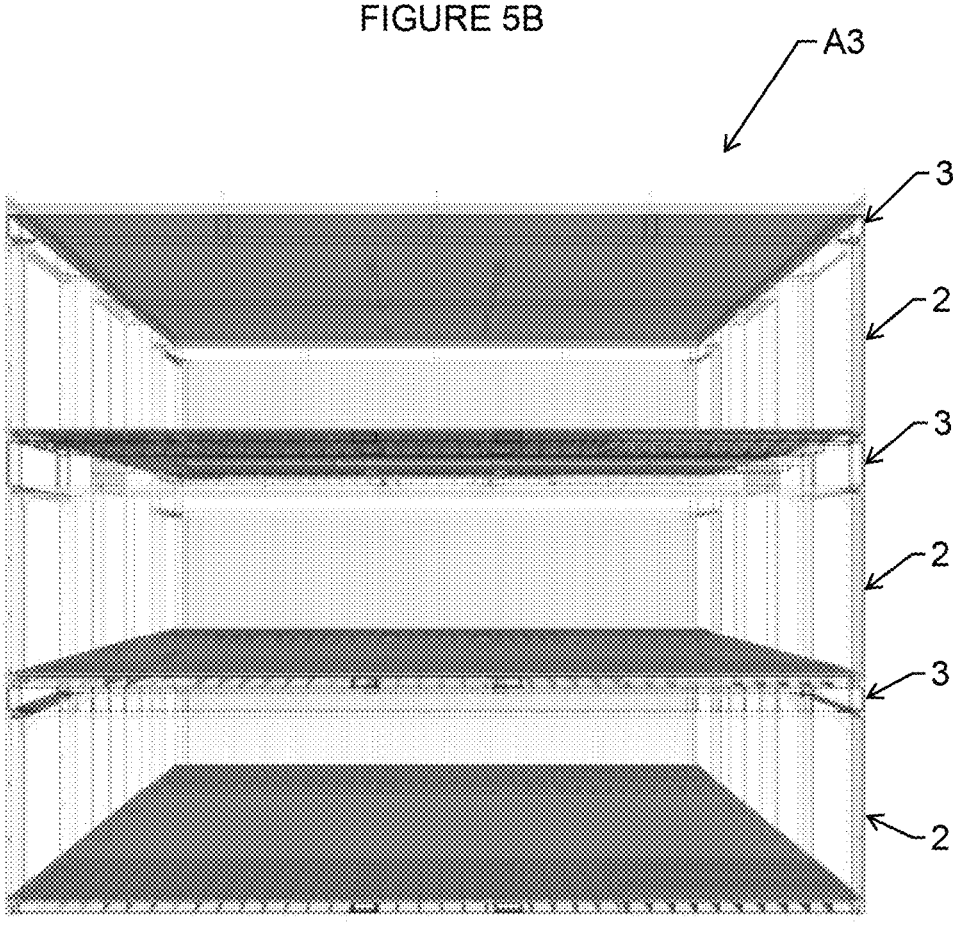
FIG. 5B is a side perspective view of the embodiment depicted in FIG. 5.
Figure 5C:
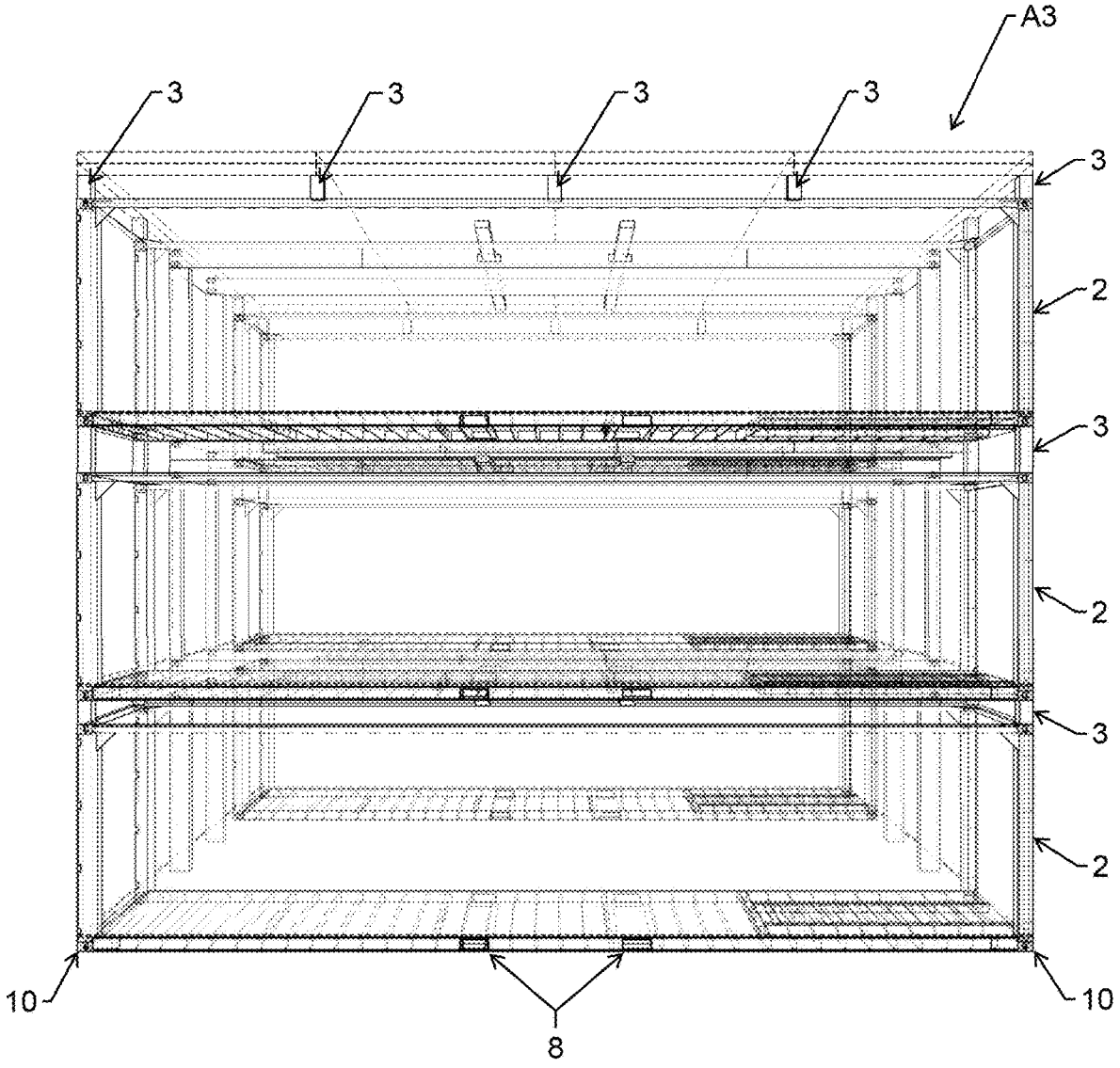
FIG. 5C is a side perspective view of the embodiment depicted in FIG. 5 with graphical modifications for purposes of clarity only.
Figure 6:
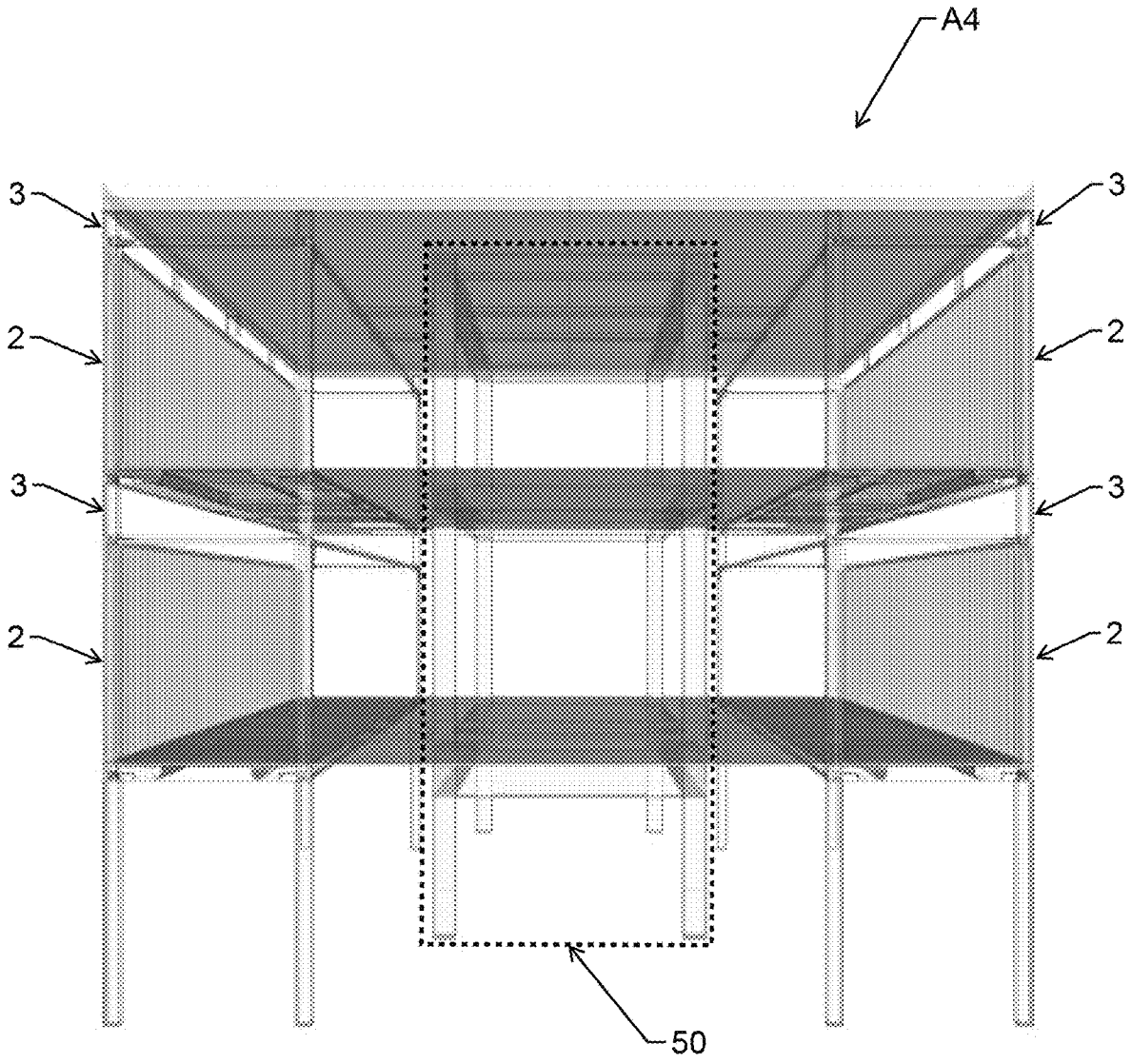
FIG. 6 is a front perspective view of a further embodiment of a building structural system with two columns of stacked box containers and one central steel frame similar to a boat storage rack.
Figure 6A:
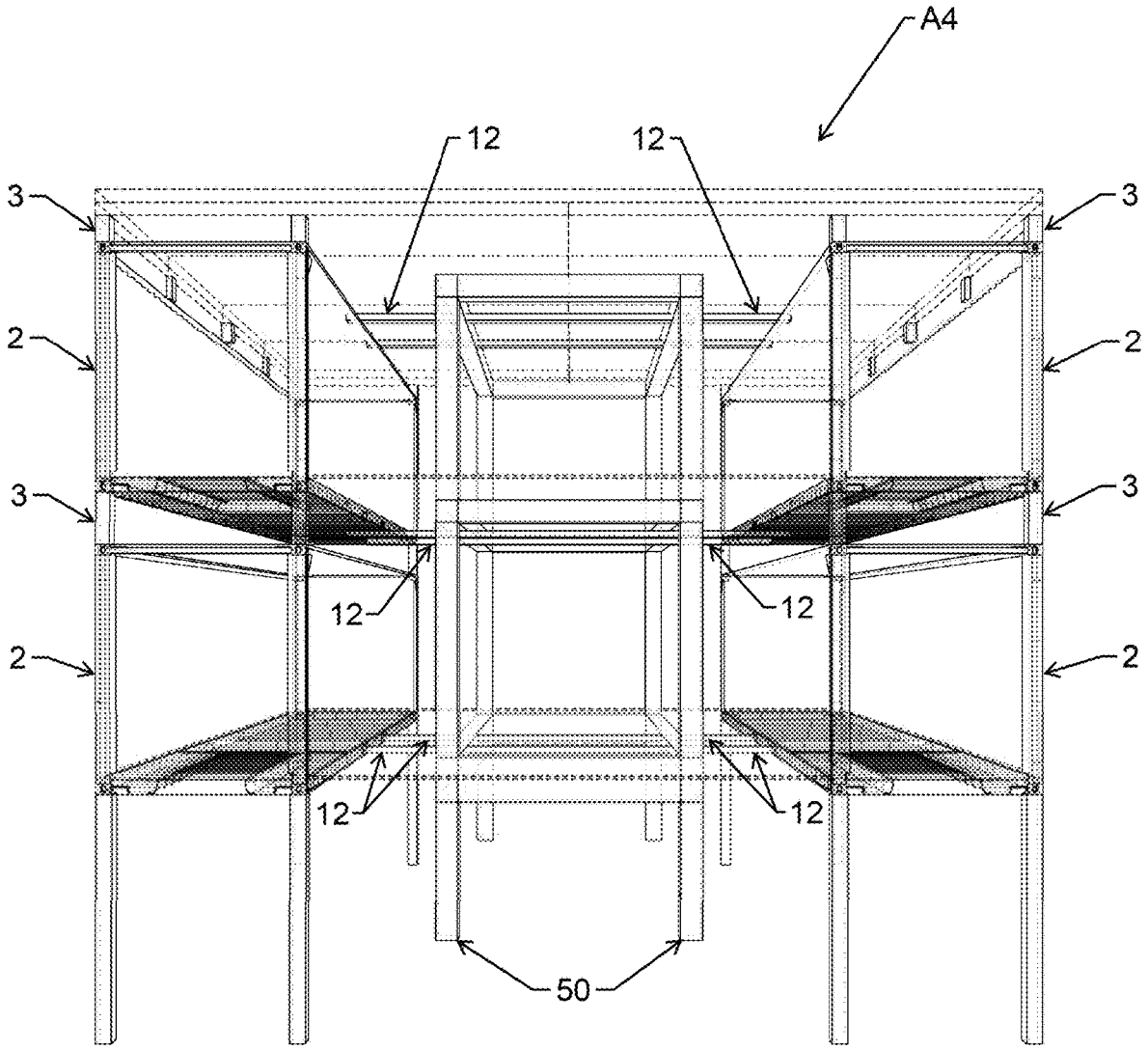
FIG. 6A is a front perspective view of the embodiment depicted in FIG. 6 with graphical modifications for purposes of clarity only.
Figure 6B:
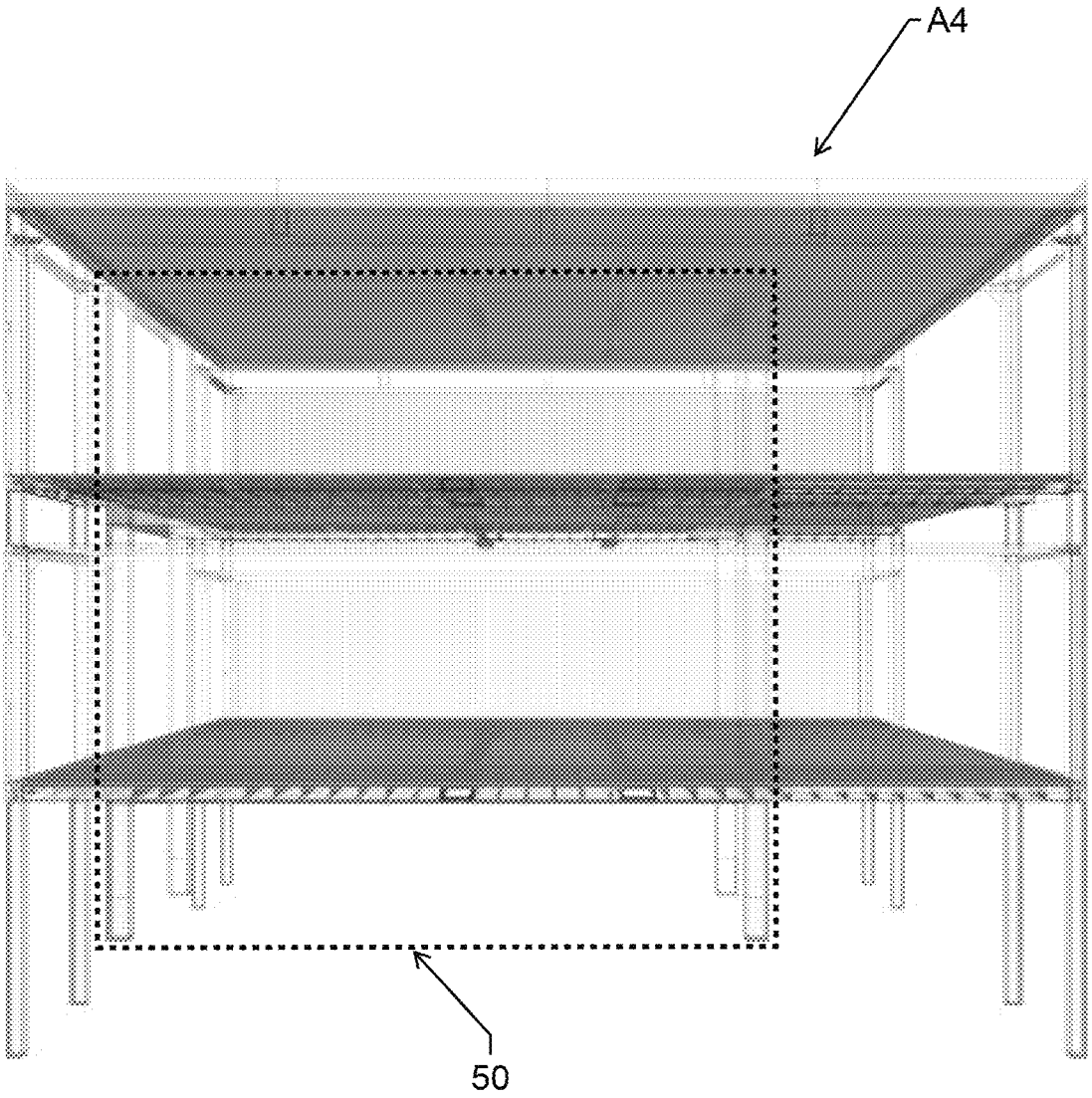
FIG. 6B is a side perspective view of the embodiment depicted in FIG. 6.
Figure 6C:
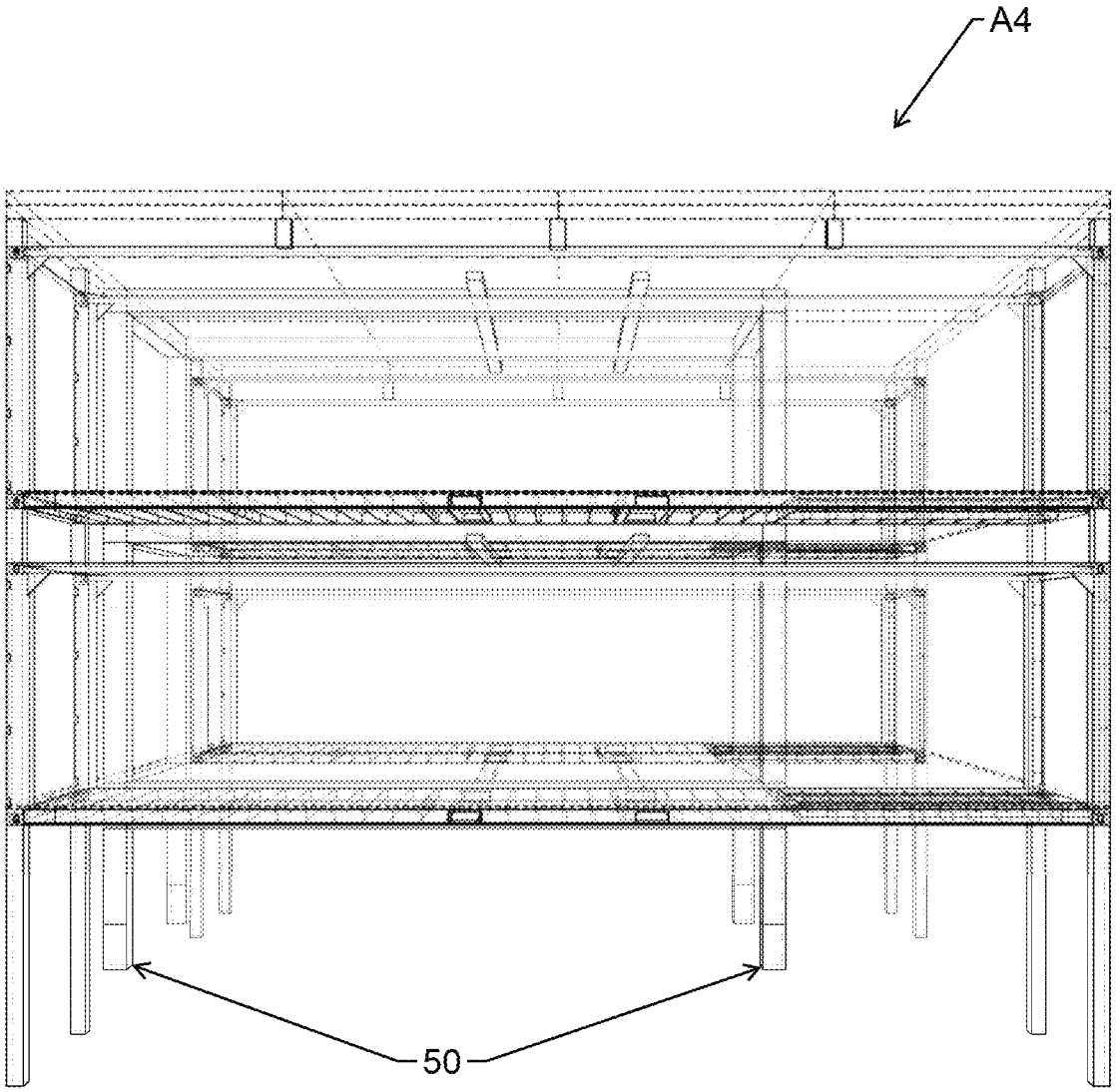
FIG. 6C is a side perspective view of the embodiment depicted in FIG. 6 with graphical modifications for purposes of clarity only.
Figure 7:
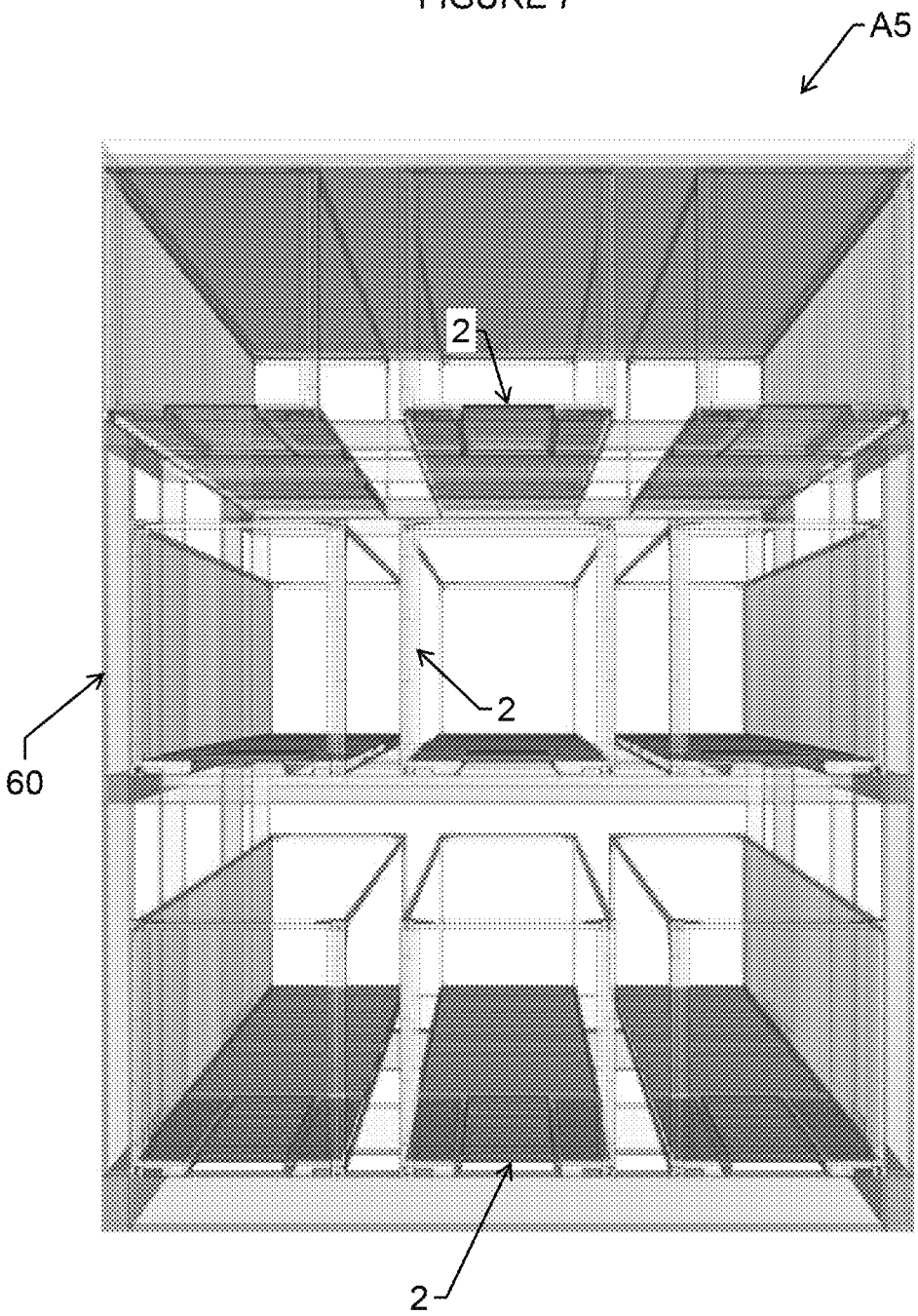
FIG. 7 is a front perspective view of a further embodiment of a building structural system with three columns of stacked box containers supported by two steel frames similar to a boat storage rack.
Figure 7A:
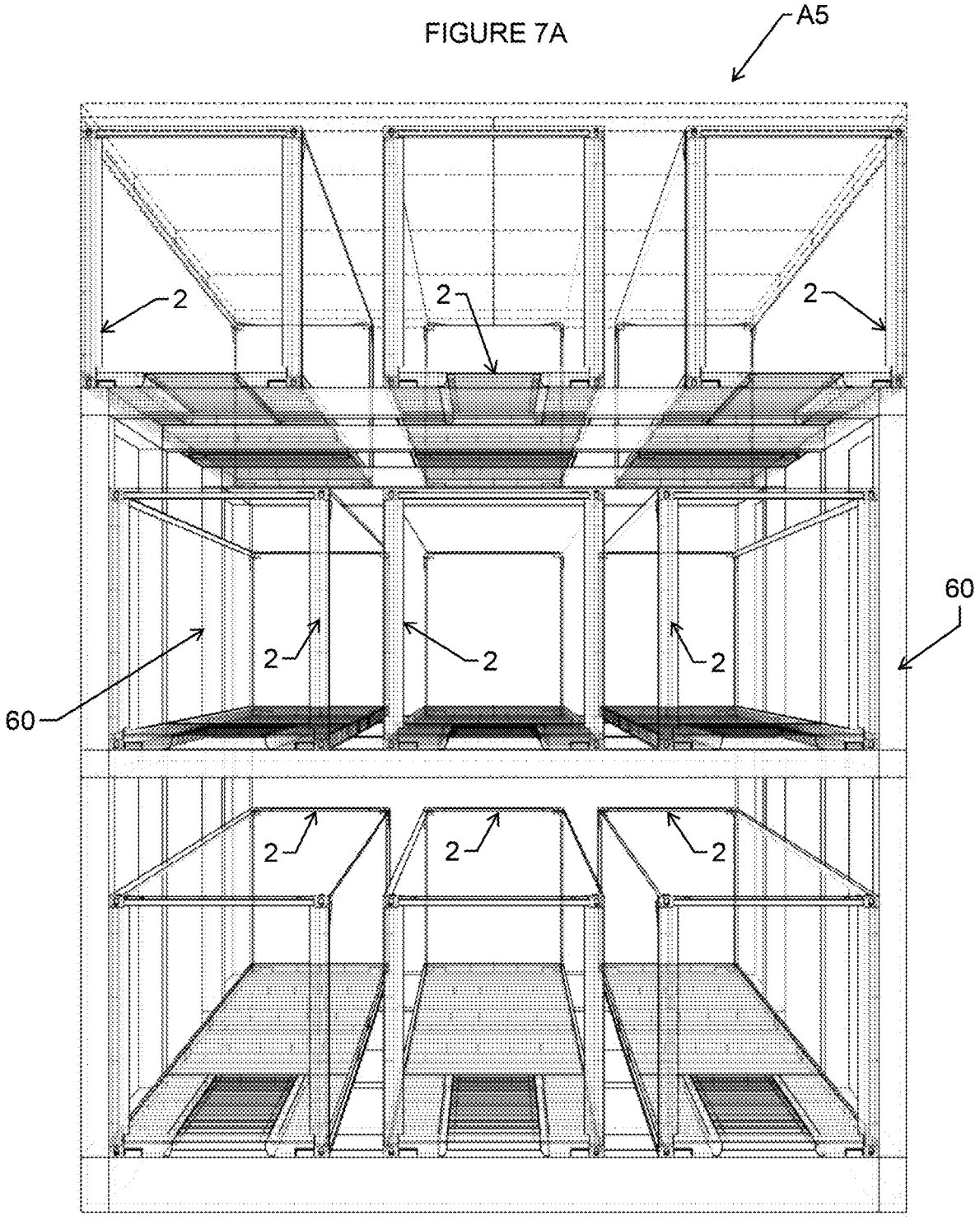
FIG. 7A is a front perspective view of the embodiment depicted in FIG. 7 with graphical modifications for purposes of clarity only.
Figure 7B:
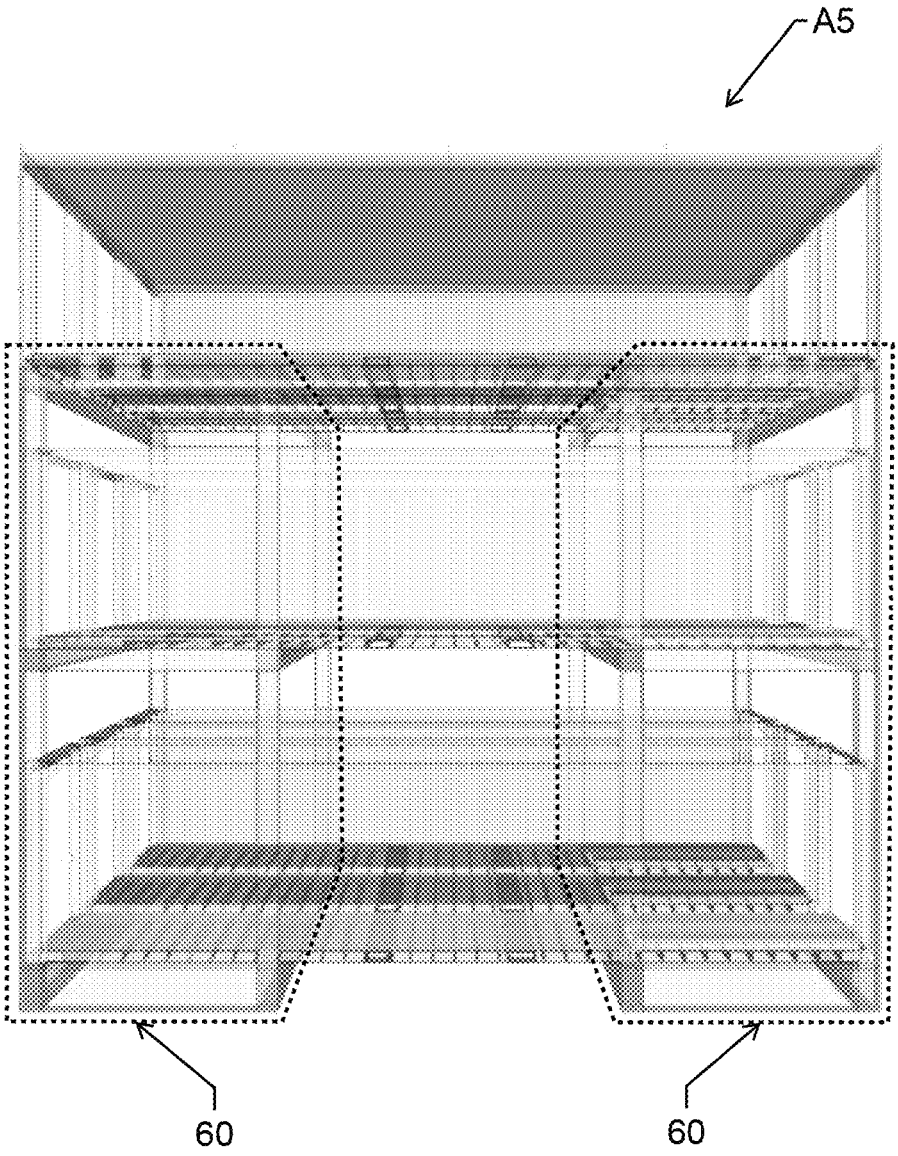
FIG. 7B is a side perspective view of the embodiment depicted in FIG. 7.
Figure 7C:
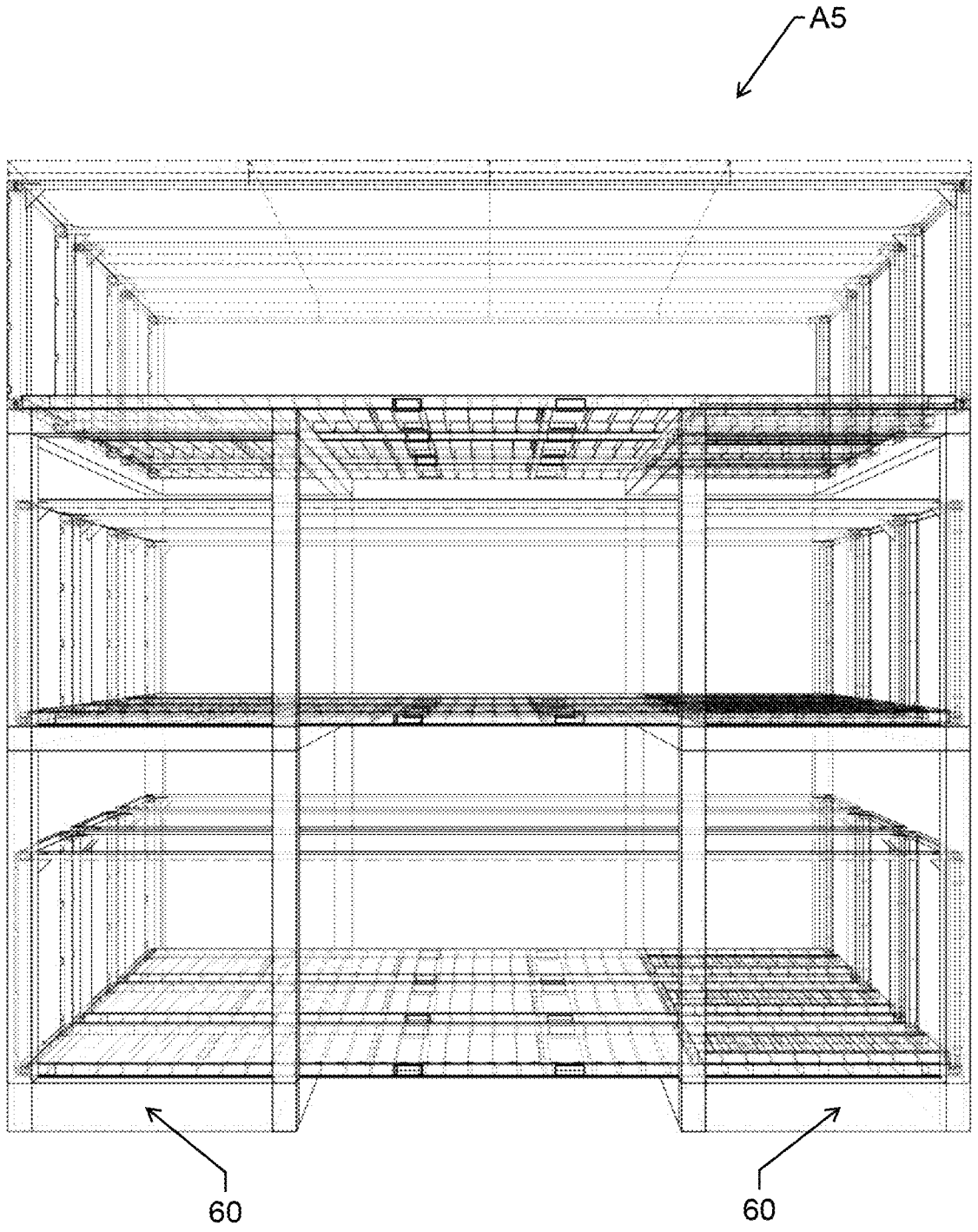
FIG. 7C is a side perspective view of the embodiment depicted in FIG. 7 with graphical modifications for purposes of clarity only.

Referring to FIG. 2 and FIGS. 2A to 2R, a preferred main structure A will be described. Main structure A includes two columns of stacked shipping containers 2 forming the left and right side portions of main structure A and a single column of stacked flat racks including flat rack 6 being an uppermost flat lack in the column of stacked flat racks and two lower flat racks 4 as seen in, for example, FIG. 2D. Widths W1 are fixed and are the widths of the container 2 and the flat racks 4 and 6, i.e., 8 ft. However, the size of the shipping containers 2 and the flat 4 and 6 racks can be varied. Widths W2 can be readily varied by varying the distance between the column of stacked flat racks and the two columns of stacked shipping containers 2. For example, the widths W2 can range from 0 ft to 8 ft.

Referring to FIGS. 2D to 2F, each column of stacked shipping containers utilizes steel spacing posts 3 to space the lowermost shipping container 2 from the middle shipping container creating a useable storage area/space directly beneath the middle shipping container to store or run various complimentary elements of the building structure including but not limited to ducting, water piping, electrical conduits or wires, etc. The spacing posts 3 can be formed from any other suitable material. A lower portion of posts 3 extend into a corresponding one of the four upper corner castings 10 of the lowermost shipping container 2 and an upper portion of posts 3 extend into a corresponding one of the four lower corner castings 10 of the middle shipping container 2. Additional spacing posts 3 may be used if desired or necessary. The spacing posts 3 may be fixed to the corresponding portions of the shipping containers using any conventional fastening means or methods (e.g., welding, bolts, etc.). The uppermost shipping container 2 is spaced from the middle shipping container 2 in the same manner using spacing posts 3 again creating a useable space directly beneath the uppermost shipping container 2 to achieve additional ceiling height. Alternatively, the useable space can be a storage space to store or run various complimentary elements of the building structure including but not limited to ducting, water piping, electrical conduits or wires, etc. The height of spacing posts 3 will depend on the ceiling level of a particular floor or story of main structure A that the spacing posts 3 are used to form. By way of example only, the height of spacing posts 3 can range from 1 ft to 3 ft although other heights may be used.

Spacing posts 18 formed from steel or other suitable material preferably space the flat racks in the column of stacked flat racks. An upper portion of each of the four lowermost spacing posts 18 (i.e., the spacing posts 18 used to form the lower level of the main structure A) extend into and are connected to a corresponding one of the four corner castings 10 of lowermost flat rack 4 to provide a large volume of open space directly below the lowermost flat rack 4 which extends to a floor of the lowermost level of main structure A. The connection can be fixed or removable and can be made using any fastening means or methods (e.g., welding, bolts, etc.).

A lower portion of each of the four middle spacing posts 18 (i.e., the spacing posts 18 used to form the middle or second level or story of the main structure A) extend into and are connected to a corresponding one of the four corner castings 10 of lowermost flat rack 4 and an upper portion of each of the four middle spacing posts 18 extend into and are connected to a corresponding one of the four corner castings 10 of upper flat rack 4 stacked on the lowermost flat rack 4 to provide the second level or story of main structure A with a large volume of open space extending between the lowermost flat rack 4 and the upper flat rack 4 of the middle or second level or story of main structure A. The connection can be fixed or removable and can be made using any fastening means or methods (e.g., welding, bolts, etc.).

The height of spacing posts 18 will depend on the ceiling level of a particular floor or story of main structure A that the spacing posts 18 are used to form. By way of example only, the height of spacing posts 18 can range from 8 ft to 15 ft although other heights may be used.

Spacing posts 3 are preferably used to space roof support G (e.g., wood ceiling joists or a wood truss) to space roof support G from the two uppermost storage containers 2 forming the third level or story of main structure A to provide a useable space that achieves additional ceiling height or can be used as a storage space which can accommodate complimentary elements of a building structure of any type including those previously described. A lower portion of four spacing posts 3 used to form the storage space between the uppermost shipping containers 2 and roof support G extend into the four upper corner casting 10 of each of the shipping containers 2 forming the third or upper level or story of main structure A. Additional spacing posts 3 (i.e., spacing posts between the corners of the shipping containers) can be used are clearly illustrated in, for example, FIG. 2E. Again, these additional spacing posts may be connected to the shipping containers 2 and the roof support G by any suitable means or methods including but not limited to those previously described.

One or more horizontally extending cross-braces 16 formed of steel or any other suitable material may be used to structurally connect the stacked columns of shipping containers 2 to the stacked column of flat racks as shown in, for example, FIGS. 2D and 2E. Cross-braces 16 can be connected to the corresponding members or elements of main structure A by any suitable means or methods including those previously described.

Further, as shown in, for example, FIGS. 2D to 2R, cross-beams 12 are preferably used to structurally connect the shipping containers 2 to the corresponding flat racks 4 and 6. Cross-beams 12 extend through each of the ends of the existing fork-lift receiving pockets or channels of the corresponding flat rack to support the corresponding flat rack in a desired elevated position.

Container connecting members 14 connect corresponding ends of cross-beams 12 to two adjacent shipping containers 2. Container connecting members 14 and cross-beams 12 can be formed as a single piece of several interconnected pieces connected using any suitable connection means or methods including those previously described. As seen in, for example FIGS. 2D, 2E, 2H and 2M, container connecting elements 14 connect and fix cross-beams 12 to two stacked shipping containers 2. As seen in, for example FIG. 2E, container connecting elements 14 are connected at a lower end to an upper rail or portion of the lowermost shipping containers 2 and an upper end of container connecting element 14 is connected to a lower portion of the shipping containers 2 of the middle or second level or story of main structure A. Preferably, the shipping containers and flat racks of each level of the main structure are structurally connected in the same manner using cross-beams 12 and container connecting elements 14.

Preferably, for each level or story of main structure A, the interior floor of the shipping containers 2 and the uppermost portion of the corresponding flat rack are horizontally aligned so that a flooring of a particular level can be directly supported on the interior floor of the shipping containers 2 and the uppermost portion of the corresponding flat racks. However, spacing elements or members can be used where the interior floor of the shipping containers 2 and the uppermost portion of the corresponding flat rack are offset.

As shown in, for example FIG. 2F, floor supports 23 can be used to support the portion of the floor of a particular level or story of the main structure A which preferably run parallel to the shipping containers and flat rack and are disposed between a shipping container and the corresponding flat rack. However, the floor supports 23 could run perpendicular to the shipping containers and the corresponding flat rack.

By using the shipping containers 2 and the flat racks 4 and 6, each level or story of the main structure A includes a large open volume of space without any or at least fewer internal supports or columns being disposed inwardly of the outer perimeter of each level of the main structure A. Also, using the shipping containers 2 and the flat racks 4 and 6 to form main structure A, main structure A can withstand more severe forces of nature (e.g., very high winds) than conventional building structures. Further, using the shipping containers 2 and the flat racks 4 and 6 to form main structure A, width Wms of main structure A can be varied and can range from, for example, 24 ft to 32 ft. The length Lms of the main structure A is fixed to 40 ft by the lengths of the flat racks and shipping container. The height Hms can be readily varied by vary the number of shipping containers and flat racks in the columns of stacked shipping containers and flat racks.

Referring to FIG. 3 and FIG. 3A to FIG. 3C, an alternative embodiment is illustrated. Main structure A1 is formed in a similar manner to main structure A but includes two columns of stacked flat racks 26 and 28 to vary the width of the building structure formed using main structure A1. Preferably, cross-beams 12 extend through each of the flat racks of the two columns of flat racks and is connected to the two outer side shipping containers using container connecting elements 14 in the same manner previously described. However, any other suitable means can be used to structurally connect the shipping containers and corresponding flat racks. The spacing of the two columns of stacked flat racks can be readily varied to vary the width of the main structure A1.

Referring to FIG. 4 and FIG. 4A to FIG. 4C, another alternative embodiment is disclosed. Main structure A2 is formed in a similar manner to main structure A but includes two levels or stories supported on a support structure 30 forming the base of main structure A2. The support structure 30 preferably includes three horizontally extending flat racks 4 that are oriented perpendicular to shipping containers 2. Each flat rack 4 is preferably supported by four spacing posts 32. The three elevated flat racks 4 are horizontally aligned and serve as a sturdy platform for the two columns of stacked shipping containers and single column of stacked flat racks forming two levels or stories of main structure A2. Each of the two levels or stories can be formed as previously described. The support structure 30 provides a large open volume of area below the flat racks 4 and between the spacing posts 32. The open volume of area has a width of approximately 38 ft. The height of this open volume of area can be readily varied by varying the height of spacing posts 32. This embodiment is particularly well suited for costal areas, flood prone areas or any other area where it is desirable to elevate one or more levels or stories of a building structure. This open volume of area can be used for a parking area or could be enclosed or a finished space. The spacing posts 32 extend into and are connected to the corresponding corner castings of the flat racks wherein such connection can be any suitable connection including those previously described.

Referring to FIG. 5 and FIG. 5A to FIG. 5C, another alternative embodiment is disclosed. Main structure A3 is formed in a similar manner to main structure A but includes pallet rack steel members 40 extending parallel to the flat racks and shipping containers and are disposed between the left side shipping containers and the flat racks and between the right side shipping containers and the flat racks. Members 40 bridge the gaps between the shipping containers and the flat racks. Members 40 can be used in place of or with cross-beams 12 and container connecting members 14. Where members 40 are used with cross-beams 12 members 40 are preferably connected or fixed to cross-beams 12.

Referring to FIG. 6 and FIG. 6A to FIG. 6C, another alternative embodiment is disclosed. Main structure A4 is formed in a similar manner to main structure A but includes a central support column 50 formed from a structure identical or similar to a conventional boat storage rack. In this embodiment, boat storage rack 50 is used in place the column of stacked flat racks as the structural mid-section support for main structure A4.

Referring to FIG. 7 and FIG. 7A to FIG. 7C, another alternative embodiment is disclosed. Main structure A5 includes two spaced boat storage racks 60 that support three level of shipping containers 2. Each level of shipping containers 2 preferably includes three horizontally aligned shipping containers 2. Each of the shipping containers 2 on each level extend perpendicular to both racks 60 as shown in, for example FIG. 7B. The center shipping containers of each level can have both sides removed to create an open space extending from the exterior walls of the left and right side shipping containers. The uppermost level of three shipping containers is support by a top or upper surface of racks 60.

Figure 8:
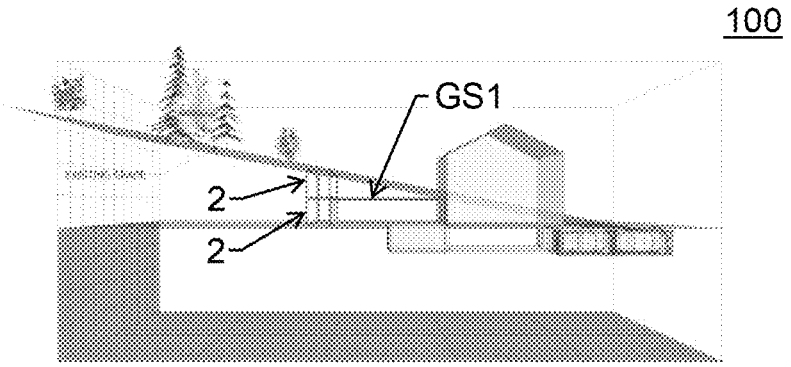
FIG. 8 is a side section view of an example of a building and site configuration with property grades sloping from rear to front.
Figure 9:
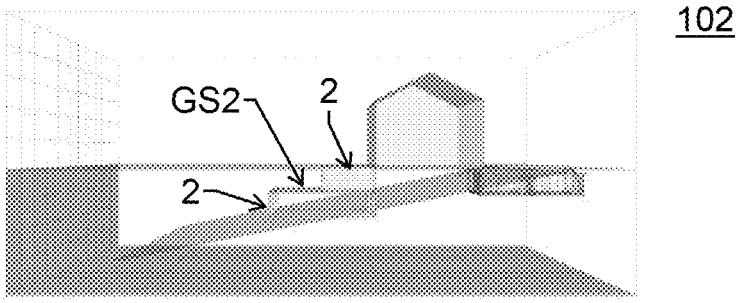
FIG. 9 is a side section view of an example of a building and site configuration with property grades sloping from front to rear.
Figure 10:
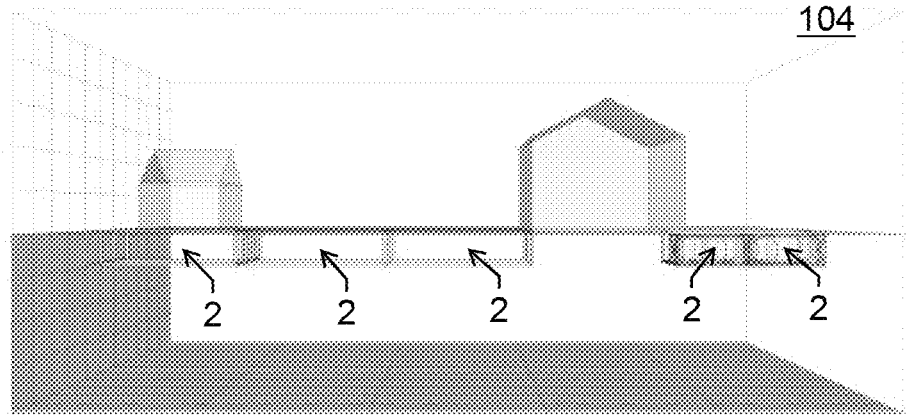
FIG. 10 is a side section view of an example of a building and site configuration with zero to low sloping property grades (flat). Complete system as shown could be designed to be raised in its entirety for floodplains, flood prone areas, etc.
Figure 11:
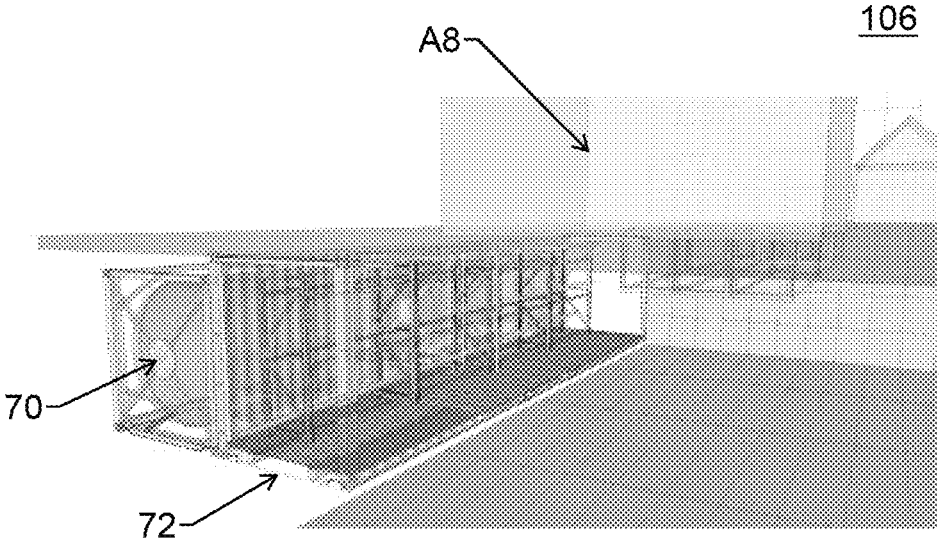
FIG. 11 is a front perspective view showing an example of site utility systems and stormwater management, configured according to the principles of the disclosure.

FIGS. 8 to 11 various cite configurations 100, 102, 104 and 106 providing examples of various site configurations in which preferred forms of the present invention can be utilized. However, it is to be understood that none of the site configurations 100, 102, 104 and 106 limit the scope of the invention. Referring to FIG. 8, grading structure GS1 is used to assist in grading a site (e.g., land terracing). The grading structure GS1 can included shipping containers 2 and/or flat racks 4 and 6. For example, grading structure GS1 can include two or more stacked shipping containers 2. Referring to FIG. 9, grading structure GS2 is used to assist in grading a site (e.g., land terracing). The grading structure GS2 can included shipping containers 2 and/or flat racks 4 and 6. For example, grading structure GS2 can include two or more stacked shipping containers 2. Referring to FIG. 10, illustrates subsurface options utilizing members of elements of the system including but not limited to shipping containers. The subsurface options include but are not limited to pools, storage, tunnel connections to detached structures, stormwater retention, potable water storage, wastewater storage, etc. Referring to FIG. 11, a main structure A8 which can take the form of any of the previously described main structures or any other suitable form disposed at grade level and storage tank container 70 (e.g., water or wastewater storage container) below the finished grade of the site. Container 70 can be housed in one or more shipping containers. Adjacent container 70 is a high cube box shipping container 72 for housing complementary components including but not limited to building utilities (e.g., sanitary sewer service, water service, electric, fiber, etc.) mounted on pallet racking in the shipping container 72.

Preferred forms of the present invention provide resilient building and site improvement construction systems and methods that may include configurations as shown for new development as well as infill, redevelopment, renovation projects, and underutilized properties. Preferred forms provide a way to standardize several building and site aspects to improve efficiency and reduce construction waste.

Preferred forms of the present invention are intended to provide ways to effectively and systematically integrate the adaptive repurposing of intermodal containers and other abundant steel materials with strategic, cost-effective methods into custom, new construction and/or redevelopment of residential, commercial and flex-use projects with a focus on efficiency, sustainability, and high-performance features as well open floor plans without central structural posts. Structural loads are transferred to the outer wall elements. Preferred forms of the present invention may provide high ceilings and maximum flexibility for floor plan layouts.

Various embodiments and aspects of the inventions are described with reference to details discussed above, and the accompanying drawings illustrate the various preferred embodiments. The above description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions. Reference in the specification to "one embodiment" or "an embodiment" or "another embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

The principles of this disclosure may be used for erecting a building and associated site improvements for single-family residence or multi-family or industrial or commercial or mixed-use building in which the plurality of ISO-type shipping containers in condition of recycled or new or with similar steel matching the specifications of ISO-type steel construction or with steel meeting specifications required to meet or exceed local building code requirements for buildings are assembled and connected in the configurations shown in this disclosure.

Construction may be on common zoning designations or uses such as residential, commercial, industrial, and public-use properties. Properties may currently be underutilized from a zoning perspective with density available. Properties may exhibit steep terrain or topography, soil conditions, or other environmental constraints such as water crossings, other water bodies, marshes, wetlands, etc. Properties may include unrealized or unused development rights within allowable setback and yard encroachments per code, subsurface or above ground or both.

For purposes of this disclosure, "components" may be added or attached to the primary building structure to improve access, operations and maintenance, enhance aesthetics, increase interior or exterior square footage and or parking, and or connect separate structures or floor levels together with covered or enclosed space. Non-limiting examples of components may include: staircases, watch or lookout towers, porches, loggias, garages, carports, breezeways, passive house aspects such as Trombe walls, window walls, solar towers (down or updraft depending on orientation), accessory dwelling, office, or studio units, and or elevator shafts as further explained within this disclosure.

The principles of this disclosure may utilize materials, mechanisms, structural and nonstructural building elements and components assembled from whole or parts thereof, individually or multiple units or combined with other new or repurposed elements listed, including but not limited to:

- Shipping containers, including low height, standard height, high cubes, adjustable (to 13.5' total height or 11.5' height of 'clearance'), general purpose or box containers, flat rack or platform containers, tank containers, refrigerated containers, plurality of open top, sided, end configurations;
- Pallet racks, various sizes and configurations; pallets, various sizes and configurations; and,
- Port racks, boat storage racks, various sizes and configurations.

A variation of the system may be constructed of specially adapted versions thereof (e.g., lighter). The specially adapted version may have the same size and shape as well as connection features as the standard elements. The weight reduction may come from use of lighter materials and or changes to structural and or enclosure features of the units.

The plurality of connections of flat rack, platform, or steel frames and beam configurations matching typical 8×20×1 or similar and 8×40×1 or similar and 8×40×2 or similar shipping containers or similar nominal steel frames with no end walls, removable end walls, fixed end walls, no corner posts, removable and or fixed and or extendable corner posts. Connections of building elements may use existing fittings such as container and or flat rack lashings, stanchions, forklift pockets/channels, gooseneck tunnel, and or corner castings; boat and pallet rack connection points.

Vertical "stacked" configuration of shipping containers in which low, regular or high cube height containers or any steel frame matching or nearly matching the specifications of ISO type shipping containers of any size are installed in a vertical configuration whereas length represents the longest or longitudinal axis of the container. Vertical elements may be used for aperture connections or ventilation piping or duct works, chimney, exhaust, utilities including but not exclusive of geothermal piping equipment, water heater piping and equipment, domestic water, fire water, reclaimed water, solar water, storm water, sanitary water (gray and or black water combined or separate), natural gas, propane gas, fiber optic, electrical service lines and equipment, cargo lift or elevator corridor, storage closets, bathrooms, stairs in any configuration, vertical poles. Stack can also be used for hiding a safe, access to a safe room or emergency exit. Feature wall, fish tanks, hidden access for maintenance, security features, fireplaces, storage, dumbwaiter, chutes, glass or feature walls, etc. Each floor level may include a finished floor within the shaft of the stack and access door.

The principles of this disclosure may be applied to real property development that is accessory to the main structure or land use. Including but not limited to private yard space, shared and or community amenities such as usable open space, pools, party rooms, piers, docks, playgrounds, animal spaces, storage shelters, community centers, etc. Services such as snow removal, lawn care, brush pickup, bulk pickup, solid waste pickup and or separation for recycling, reuse, repurpose, etc. Proposed uses may also include private accessway connections to public systems such as alleys, walkways, sidewalks, pathways with or without ramps for pedestrians or other modes. Connections may be of threshold type, roller, fixed, telescoping or cantilever. Connections may include stair landings, stoops, sloped surfaces, loading areas, clear spans with corner piers or pile foundations or cantilever.

The principles of this disclosure may be applied to real property development that is accessory to the main structure or land use. Including but not limited to underground tunnels with or without connections to the main structure. Other features may include access or service hatches, site perimeter barriers, site or perimeter tracks, surveillance or clear site line zones requiring ground surfaces clear of vegetation or other above ground site features. Fences may be near the perimeter system for security and or privacy. Vertical or horizontal elements may include a 20-foot vertical container for recreation with internal stairs (5-foot diameter spiral required by code; 6-foot diameter preferred), treehouse platform, roof, lights/power outlets, insulated walls, disguised as an artificial tree. Live vegetation could be incorporated sparingly or throughout. Recreational, kid-friendly exterior attachments such as slides, fireman's poles, swings (rope, tire, etc.), monkey bars, climbing wall, ladders and bungee/mesh platforms could be added as options. Practical considerations include the temperature of steel/iron in the summer, therefore other materials may be incorporated to both provide shade and buffer direct contact with steel members. Other considerations for the design would factor in line of sight to and from rear of home and patio/deck areas.

Site utility elements may include a single or multiple horizontal, subsurface container(s) near the center of the building, outside of the footprint of the primary building structure. The "tunnel" would exit near the front-center of the home foundation and terminate in the front yard. One or both of the container side walls would be modified with a racking system for various utility connections entering the property. No tunnel connection to the street but rather this provides a lockable access hidden in the front yard (junction box, planter or manhole) for utility providers to connect. $2^{nd}$ lockable access can be provided at the building foundation line. Security, ease of maintenance and durability is top of mind. "Tunnel" would essentially be a hallway corridor from the vertical utility stack and elevator stack. If soils and water table allow for a basement, the "tunnel" would connect to the basement living area, storage, or garage of the home or building for easy access.

The principles of this disclosure may be used for developing areas with poor soil conditions, challenging terrain, steep topography or terrain sites, environmentally sensitive sites, or flood-prone areas in need of additional floodwater storage.

The principles of this disclosure may be used for sites with localized flooding by way of intermittent standing water at sites with flat ground, poor land slope or zero or low grade change (0-3% slopes approx.), clogged inlets and or drainage systems, and or poor overland relief.

The principles of this disclosure may be used for properties with low soil infiltration or permeability at the ground surface or below ground surface layer or layers that may include rock, clay, previous fill or earthwork operations, altered subsurface conditions such as abandoned tanks, utilities, foundations, structures, debris, etc.

The principles of this disclosure may be applied to locations including but not limited to urban infill lots, brownfield sites, superfund sites, greenfield sites, suburban, exurban (metro area) and rural settings.

The principles of this disclosure may be applied to "waterfront" property or properties on a waterbody. A waterbody is any significant accumulation of water. The term most often refers to oceans, seas, lakes, and reservoirs but also includes smaller pools of water such as ponds, wetlands, vegetated or forested areas that can exist fully within the waterbody. A body of water does not have to be still or contained or visible from the ground surface; rivers, streams, canals, canals with lock systems, other interconnected, regional, public or private collection, conveyance, or treatment facilities. Smaller or lesser known associations may include stormwater facilities, natural or manmade or more typically a combination, blend, or integration of several different facility types: i.e. retention, detention, holding, harvesting, reuse/repurpose, recharge (or infiltration), peak flow reduction or attenuation of peak discharge out of the facility (water volume rate, water velocity rate, water temperature, water pollutant loads, other monitoring and testing), landform, structure, nutrient removal, rainfall conveyance and collection systems, open and closed systems such as culverts, pipes, swales, cisterns, harvesting tanks, landscaping, infiltration facilities or structures, manholes, inlets, trenches, rain barrels or vegetated areas.

The principles of this disclosure may be applied to real property development in single or multiple phases. Multiphased projects can link together quickly through the use of standardized and consistent building and site improvements. Fast-track and or larger projects may be able to expedite early site work, more predictable rough grading, new utility system installations and rough ins, footings and foundations, erosion and sediment control measures, and environmental remediation. Stormwater facilities and other utilities and or subsurface features may be integrated as usable or amenity space.

Containers and all racking elements included in this disclosure could be on piers, piles, strip footings, slab, tub or basin foundation, guide rail system with wheel, rail, track, or bearings; containers may be open top full or partial, open one side or both fully or partially, ends, or bottom for acrylic, glass, other translucent flooring.

Foundations, landscaping or vegetated areas over structure, pathway, building veneer, other thermal mass or heavier or high density elements that may include precast footings, piers, piles, screw type piers or footings, strip or beam footing, barrel footings each with or without geotextile liner, subbase or drainage layer or piping system, bin blocks, gabions, stone, concrete, blocks, bricks, steel, wood, etc. may be locally sourced near the project or shipped multimodally. Additional foundation options may include a floating barge and or bearings on fixed guideways or similar to "Pontoon" style in which the home or structure sits in a precast "tub" or "pontoon" that allows the entire structure floating above the fixed "tub" to temporarily rise and lower in finished floor elevation as floodwater and/or groundwaters recede. Fixed guideways with wheel or rail systems will automatically adjust to conditions and allow access to the edge of the property, similar to a floating dock. Piping systems may include a perforated pipe system, a French drain, or similar wall or foundation collection and conveyance system to reduce hydrostatic pressure and moisture against the structure below the ground surface by draining subsurface water away.

Other materials and elements that may be locally sourced near the project site or shipped multimodally include roof systems. Roof systems may include shingles, liners, flat roof membranes, flat roof pavers, vegetated areas over structure that may include complete traytype system or modules, pre-planted mat systems, plug, pot or custom system.

Roof trusses are precut, pre-drilled, test fit to the steel frame in the factory, then disassembled as required for shipment via single unit truck, tractor trailer, railway, waterway, or airway within a general purpose (GP) high cube shipping container, flat rack or platform type of container, or similar intermodal container. Roof trusses can also be shipped "multimodally" to the project site on flat rack or platform containers via flatbed trailer, tilt bed single unit vehicle, tilt bed, chassis, skeleton or tiller type trailer. The full or partial roof truss assemblies may be delivered inside one of the lighter use project units or returnable container(s) that are used for project specific materials only.

Also included are water features, pools, hot tubs, photovoltaic panels, pipes, chases, shafts, steps, railing, pallets, pallet racking systems, wall studs, wall panels, ceiling panels, finish flooring, raised flooring, bulkheads, structural and nonstructural elements, wood framing, windows, doors, can "regionalize" for different home styles, climate, terrain, infrastructure systems and transportation network Onsite systems may include prefabricated or package type water treatment, stormwater storage and treatment, and or wastewater treatment systems such as MBBR, anaerobic, aerobic, or wastewater collection tank (septic tank) with overflow to infiltration area or leach field that may include a manifold type, perforated pipe system with observation well, vents, or similar access openings.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. A building structure, comprising:

(a) a first building level of a building structure formed from at least a first high cube box shipping container and a second high cube box shipping container;

(b) said first high cube box shipping container forming at least a first side portion of the first building level and said second high cube box shipping container forming at least a second side portion of the first building level, wherein said roof, both end walls and a sidewall of each of said first and second high cube box shipping containers are removed to provide a first floor space extending between an exterior sidewall of said first high cube box shipping container and an exterior wall of said second high cube box shipping container;

(c) a horizontally extending structural support extending between and connecting the first and second high cube box shipping containers, the horizontally extending structural support having a plurality of openings extending therethrough so that a fork-lift can engage and lift the horizontally extending structural support from either side of the horizontally extending structural support, wherein the horizontally extending structural support is a flat rack; and, (d) a floor of said first building level being operably connected to each of said first high cube box shipping container and said second high cube box shipping container.

2. The building structure of claim 1, wherein:

(a) said floor is supported at a first end by a bottom of said first high cube box shipping container and at a second end by a bottom of said second high box shipping container, said second end of said floor opposing said first end of said floor.

3. The building structure of claim 1, wherein:

(a) said first and second high cube box shipping containers have a height of approximately 9.5 feet, a width of approximately 8 feet and a length of approximately 40 feet.

4. The building structure of claim 1, wherein:

(a) the first and second high cube box shipping containers have a height sufficient so that the first building level has a height ranging from 7 feet to at least 8.5 feet.

5. The building structure of claim 1, wherein:

(a) the first and second high cube box shipping containers have a lower section including a plurality of openings sized so that a fork of a fork-lift can selectively be inserted into any of said plurality of openings so that a fork-lift can readily transport the first and second high cube box shipping containers.

6. A building structure, comprising:

(a) a first building level of a building structure formed from at least a first high cube box shipping container and a second high cube box shipping container;

(b) said first high cube box shipping container forming at least a first side portion of the first building level and said second high cube box shipping container forming at least a second side portion of the first building level, wherein said first and second high cube box shipping containers are configured to provide a first floor space extending between an exterior sidewall of said first high cube box shipping container and an exterior wall of said second high cube box shipping container;

(c) a horizontally extending structural support extending between and connecting the first and second high cube box shipping containers, the horizontally extending structural support having a plurality of openings extending therethrough so that a fork-lift can engage and lift the horizontally extending structural support from either side of the horizontally extending structural support;

(d) a floor of said first building level being operably connected to each of said first high cube box shipping container and said second high cube box shipping container; and, (e) at least one cross-beam extending through one of the plurality of openings of said horizontally extending structural support, said at least one cross-beam being attached at one end to said first high cube box shipping container and at an opposing end to said second high cube box shipping container.

7. The building structure of claim 6, wherein:

(a) the horizontally extending structural support is a flat rack.

8. A method of forming a building structure, comprising the steps of:

(a) providing a first high cube box shipping container and a second high cube box shipping container, each of said first high cube box shipping container and said second high cube box having a plurality of openings extending therethrough so that a fork-lift can engage and lift a corresponding high cube box shipping container;

(b) positioning said first high cube box shipping container to form at least a first side portion of a first level of a building structure;

(c) positioning said second high cube box shipping container to form at least a second side portion of the first level of the building structure, wherein said first and second high cube box shipping containers are configured to provide an interior space of the first level of the building structure extending between an exterior sidewall of said first high cube box shipping container and an exterior wall of said second high cube box shipping container;

(c) providing a container connector including a first connection end, a second connection end and a cross-beam extending between said first connection end and said second connection end;

(d) inserting the first connection end of the container connector into one of said plurality of openings of said first high cube box shipping container and the second connection end of the container connector into one of said plurality of openings of said second high cube box shipping container to connect and space said first high cube shipping container from said second high cube box shipping container; and, (e) operably connecting a floor to said first high cube box shipping container and said second high cube box shipping container wherein a portion of said floor extends along said cross-beam and between said first high cube box shipping container and said second high cube box shipping container.

9. The method of claim 8, wherein:

(a) said first and second high cube box shipping containers have a height of approximately 9.5 feet, a width of approximately 8 feet and a length of approximately 40 feet.

10. The method of claim 8, further including the steps of:

(a) stacking a third high cube box shipping container on said first high cube box shipping container;

(b) stacking a fourth high cube box shipping container on said second high cube box shipping container, wherein said roof, both end walls and a sidewall of each of said first, second, third and fourth high cube box shipping containers are removed to provide an interior space of a second level of the building structure extending between an exterior sidewall of said third high cube box shipping container and an exterior wall of said fourth high cube box shipping container.

11. The method of claim 10, further including the steps of:

(a) providing a first set of a plurality of vertically extending posts between said first and third high cube box shipping containers to create a useable space between said first high cube box shipping container and said third high cube box shipping container; and, (b) providing a second set of a plurality of vertically extending posts between said second and fourth high cube box shipping containers to create a useable space between said second high cube box shipping container and said fourth high cube box shipping container;

(c) one end of a first vertically extending post of said first set of a plurality of vertically extending posts extends into a corner casting of said first high cube box shipping container and an opposing end of said first vertically extending post extends into a corner casting of said third high cube box shipping container; and, (d) one end of a first vertically extending post of said second set of a plurality of vertically extending posts extends into a corner casting of said second high cube box shipping container and an opposing end of said first vertically extending post extends into a corner casting of said fourth high cube box shipping container.

12. A method of forming a building structure, comprising the steps of:

(a) providing a first high cube box shipping container and a first flat rack;

(b) positioning said first high cube box shipping container to form at least a first side portion of a first level of a building structure, wherein said roof, both end walls and a sidewall of said first high cube box shipping container are removed to provide an interior space of the first level of the building structure extending between an exterior sidewall of said first high cube box shipping container and an interior wall of said first high cube box shipping container;

(c) horizontally offsetting said first flat rack from said first high cube box shipping container such that a floor of said first high cube box shipping container is substantially horizontally aligned with a top surface of said first flat rack, wherein said first flat rack has a plurality of openings extending therethrough so that a fork-lift can engage, and lift said first flat rack from either side of said first flat rack; and, (d) inserting a portion of a first cross-beam into one of said plurality of openings of said first flat rack and connecting a first end of said first cross-beam to a portion of said first high cube box shipping container.

13. The method of claim 12, further including the steps of:

(a) providing a second high cube box shipping container; and, (b) positioning said second high cube box shipping container to form at least a second side portion of the first level of the building structure, wherein said roof, both end walls and a sidewall of said second high cube box shipping container are removed to provide an interior space of the first level of the building structure extending between an exterior sidewall of said second high cube box shipping container and an interior wall of said second high cube box shipping container.

14. The method of claim 13, further including the steps of:

(a) connecting a second end of said first cross-beam to a portion of said second high cube box shipping container.

15. The method of claim 14, further including the steps of:

(a) inserting a portion of a second cross-beam into another of said plurality of openings and connecting a first end of said second cross-beam to a portion of said first high cube box shipping container and connecting a second end of said second cross-beam to a portion of said second high cube box shipping container.

16. The method of claim 15, further including the steps of:

(a) positioning a third high cube box shipping container above said first high cube box shipping container such that said third high cube box shipping container is vertically aligned with said first high cube box shipping container;

(b) positioning a fourth high cube box shipping container above said second high cube box shipping container such that said fourth high cube box shipping container is vertically aligned with said second high cube box shipping container;

(c) providing a first set of a plurality of vertically extending posts between said first and third high cube box shipping containers to create a useable space between said first high cube box shipping container and said third high cube box shipping container;

(d) providing a second set of a plurality of vertically posts between said second and fourth high cube box shipping containers to create a useable space between said second high cube box shipping container and said fourth high cube box shipping container;

(e) one end of a first vertically extending post of said first set of a plurality of vertically extending posts extends into a corner casting of said first high cube box shipping container and an opposing end of said first vertically extending post extends into a corner casting of said third high cube box shipping container; and, (f) one end of a first vertically extending post of said second set of a plurality of vertically extending posts extends into a corner casting of said second high cube box shipping container and an opposing end of said first vertically extending post extends into a corner casting of said fourth high cube box shipping container.

17. The method of claim 16, further including the step of:

(a) providing a second flat rack between said third and fourth high cube box shipping containers, wherein said second flat rack has a plurality of openings extending therethrough so that a fork-lift can engage, and lift said second flat rack from either side of said second flat rack.

18. The method of claim 17, further including the step of:

(a) inserting a portion of a third cross-beam into one of said plurality of openings of said second flat rack and connecting a first end of said third cross-beam to a portion of said third high cube box shipping container and connecting a second end of said third cross-beam to a portion of said fourth high cube box shipping container.

19. The method of claim 18, further including the step of:

(a) inserting a portion of a fourth cross-beam into one of said plurality of openings of said second flat rack and connecting a first end of said fourth cross-beam to a portion of said third high cube box shipping container and connecting a second end of said fourth cross-beam to a portion of said fourth high cube box shipping container.

* * * * *